US011855331B2

(12) United States Patent
Jung et al.

(10) Patent No.: US 11,855,331 B2
(45) Date of Patent: Dec. 26, 2023

(54) BROADBAND ANTENNAS MOUNTED ON VEHICLE

(71) Applicants: LG ELECTRONICS INC., Seoul (KR); KOREA ADVANCED INSTITUTE OF SCIENCE AND TECHNOLOGY, Daejeon (KR)

(72) Inventors: Kangjae Jung, Seoul (KR); Ilnam Cho, Seoul (KR); Jongwon Yu, Daejeon (KR); Kwangseok Kim, Daejeon (KR); Jeongwook Kim, Daejeon (KR)

(73) Assignees: LG ELECTRONICS INC., Seoul (KR); KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 18/013,233

(22) PCT Filed: Aug. 24, 2021

(86) PCT No.: PCT/KR2021/011314
§ 371 (c)(1),
(2) Date: Dec. 27, 2022

(87) PCT Pub. No.: WO2022/075587
PCT Pub. Date: Apr. 14, 2022

(65) Prior Publication Data

US 2023/0261357 A1 Aug. 17, 2023

(30) Foreign Application Priority Data

Oct. 6, 2020 (KR) ..... 10-2020-0128856

(51) Int. Cl.
*H01Q 1/12* (2006.01)
*H01Q 5/50* (2015.01)
(Continued)

(52) U.S. Cl.
CPC ..... *H01Q 1/1271* (2013.01); *H01Q 1/18* (2013.01); *H01Q 1/38* (2013.01); *H01Q 5/50* (2015.01)

(58) Field of Classification Search
CPC ..... H01Q 1/12; H01Q 1/32; H01Q 1/38–48; H01Q 5/50
See application file for complete search history.

(56) References Cited

U.S. PATENT DOCUMENTS 7,656,357 B2 2/2010 Ishibashi et al.
8,269,676 B2 * 9/2012 Lin ..... H01Q 5/40 343/702
(Continued)

FOREIGN PATENT DOCUMENTS

KR 20160036436 4/2016
KR 20200098740 8/2020

OTHER PUBLICATIONS

Lombardi III, et al., "Copper Transparent Antennas on Flexible Glass by Substractive and Semi-Additive Fabrication for Automotive Applications", 2018 IEEE 68th Electronic Components and Technology Conference (ECTC), Jun. 2018, 10 pages.
(Continued)

*Primary Examiner* — Hasan Islam
(74) *Attorney, Agent, or Firm* — LEE HONG DEGERMAN KANG WAIMEY

(57) ABSTRACT

An antenna assembly comprises: a dielectric substrate; a first ground region disposed on one side of a feed line disposed on the dielectric substrate; a radiator region in which a first side and a second side corresponding to the opposite side of the first side form end portions of conductive patterns such that the conductive patterns having different widths are formed in a plurality of step structures; and a second ground region disposed on the other side of the feed line, wherein the first ground region may be formed to have a length
(Continued)

greater than or equal to that of the second ground region in one axial direction. The number of steps on the second side may be greater than or equal to the number of steps on the first side.

20 Claims, 36 Drawing Sheets

(51) Int. Cl.
*H01Q 1/38* (2006.01)
*H01Q 1/18* (2006.01)

(56) References Cited

U.S. PATENT DOCUMENTS

| | | | | |
|---|---|---|---|---|
| 2012/0200468 | A1 | 8/2012 | Cooper et al. | |
| 2019/0386386 | A1* | 12/2019 | Fernandez | H01Q 1/005 |
| 2021/0066801 | A1* | 3/2021 | Tsai | H01Q 5/385 |

OTHER PUBLICATIONS

PCT International Application No. PCT/KR2021/011314, International Search Report dated Dec. 14, 2021, 4 pages.

* cited by examiner (a) scenario 1

(b) scenario 2

(c) scenario 3

(d) scenario 4

(e) scenario 5

(f) scenario 6

BROADBAND ANTENNAS MOUNTED ON VEHICLE

CROSS-REFERENCE TO RELATED APPLICATIONS

This application is the National Stage filing under 35 U.S.C. 371 of International Application No. PCT/KR2021/011314, filed on Aug. 24, 2021, which claims the benefit of earlier filing date and right of priority to Korean Application No. 10-2020-0128856, filed on Oct. 6, 2020, the contents of which are all incorporated by reference herein in their entirety.

TECHNICAL FIELD

This specification relates to a wideband antenna disposed in a vehicle. One particular implementation relates to an antenna system having a wideband antenna that is made of a transparent material to operate in various communication systems, and to a vehicle having the same.

BACKGROUND ART

A vehicle may perform wireless communication services with other vehicles or nearby objects, infrastructures, or a base station. In this regard, various communication services can be provided through a wireless communication system to which an LTE communication technology or a 5G communication technology is applied. some of LTE frequency bands may be allocated to provide 5G communication services.

On the other hand, there is a problem in that a vehicle body and a vehicle roof are formed of a metallic material to block radio waves. Accordingly, a separate antenna structure may be disposed on a top of the vehicle body or the vehicle roof. Or, when the antenna structure is disposed on a bottom of the vehicle body or roof, a portion of the vehicle body or roof corresponding to a region where the antenna structure is disposed may be formed of a non-metallic material.

However, in terms of design, the vehicle body or roof needs to be integrally formed. In this case, the exterior of the vehicle body or roof may be formed of a metallic material. This may cause antenna efficiency to be drastically lowered due to the vehicle body or roof.

In order to increase a communication capacity without a change in the exterior design of the vehicle, a transparent antenna may be disposed on glass corresponding to a window of the vehicle. However, antenna radiation efficiency and impedance bandwidth characteristics may be deteriorated due to an electrical loss of the transparent antenna.

Meanwhile, a structure in which an antenna layer with an antenna pattern and a ground layer with a ground pattern are disposed on different planes is generally used. In particular, when operating as a wideband antenna, it is necessary to increase a thickness between the antenna layer and the ground layer. However, for a transparent antenna for a vehicle, an antenna region and a ground region need to be disposed on the same layer. Such an antenna in which the antenna pattern and the ground pattern are disposed on the same layer is difficult to operate as a wideband antenna.

DISCLOSURE OF INVENTION

Technical Problem

The present disclosure is directed to solving the aforementioned problems and other drawbacks. The prevent disclosure also describes an antenna made of a transparent material that is capable of operating in a wideband range while providing LTE and 5G communication services.

The present disclosure further describes a wideband antenna structure made of a transparent material that can be implemented in various shapes on a single plane.

The present disclosure further describes a wideband antenna structure made of a transparent material that can reduce a feeding loss and improving antenna efficiency while operating in a wide band.

The present disclosure further describes an antenna structure made of a transparent material that can improve antenna efficiency and can be reduced in size while operating in a wideband range.

The present disclosure further describes a structure in which a transparent antenna having improved antenna efficiency while operating in a wideband range can be disposed at various positions on a window of a vehicle.

The present disclosure further describes improvement of communication performance by arranging a plurality of transparent antennas on glass of a vehicle or a display of an electronic device.

Solution to Problem

An embodiment of the present disclosure provides an antenna assembly including: a dielectric substrate; a first ground region disposed on one side of a feed line disposed on the dielectric substrate; a radiator region in which a first side and a second side corresponding to the opposite side of the first side form end portions of conductive patterns such that the conductive patterns having different widths are formed in a plurality of step structures; and a second ground region disposed on the other side of the feed line, wherein the first ground region is formed to have a length greater than or equal to that of the second ground region in one axial direction, and the number of steps on the second side is greater than or equal to the number of steps on the first side.

In an embodiment, the radiator region may be disposed only in an upper region of either the first ground region or the second ground region.

In an embodiment, the first side in the radiator region may be formed in a linear structure, and the second side in the radiator region may form a plurality of step structures by the conductive patterns having different widths.

In an embodiment, the first side in the radiator region adjacent to the first ground region in one axial direction may be formed in a linear structure.

In an embodiment, the first side of the radiator region may be formed in M step structures in an upper part of the first ground region, the second side of the radiator region disposed over the second ground region may be formed in N step structures, where N is a number greater than M, and the first ground region may be made longer than the second ground region in one axial direction.

In an embodiment, the first ground region may be smaller in width than the second ground region in the other axial direction, which reduces the width of the antenna assembly.

In an embodiment, end portions on the first side of the radiator region formed over the first ground region may be formed between opposite ends of the first ground region, so that the antenna assembly operates over a wide band by an interaction between a current in the radiator region and a current in the second ground region.

In an embodiment, end portions on the second side of the radiator region formed over the second ground region may be formed between opposite ends of the second ground region, so that the antenna assembly operates over a wide band by an interaction between a current in the radiator region and a current in the second ground region.

In an embodiment, the feed line may be disposed in a lower region of the dielectric substrate, and the conductive patterns of the radiator region may be configured in such a way as to become wider in the other axial direction toward a higher position in the one axial direction.

In an embodiment, the conductive patterns of the radiator region may be configured in such a way as to become shorter in the one axial direction toward the feed line in the one axial direction.

In an embodiment, the conductive patterns of the radiator region may be disposed symmetrically in the other axial direction with respect to an extension line of the feed line formed in the one axial direction.

In an embodiment, the conductive patterns of the radiator region may be disposed asymmetrically in the other axial direction with respect to an extension line of the feed line formed in the one axial direction, which reduces the width of the antenna assembly.

In an embodiment, the radiator region may include: a first region corresponding to an upper region, and consisting of a plurality of conductive patterns whose end portions on the first side are in different positions on the first side; and a second region corresponding to a lower region which lies under the first region, and formed such that end portions on the first side are spaced apart from a boundary of the first ground region, wherein the width of the conductive patterns in the first region is greater in a higher position.

In an embodiment, a boundary of the first side of the radiator region in the second region may be disposed to face the boundary of the first ground region, spaced apart therefrom.

In an embodiment, at least part of the first side formed by the conductive patterns of the radiator region may be formed in a liner structure, and the second side in the radiator region may form a plurality of step structures by the conductive patterns having different widths.

In an embodiment, the radiator region, the feed line, the first ground region, and the second ground region may be formed as a metal mesh pattern in which a plurality of grids is electrically connected, the antenna assembly may be implemented as a transparent antenna on the dielectric substrate, and the radiator region, the feed line, the first ground region, and the second ground region, which constitute the transparent antenna, may be disposed on the dielectric substrate, thereby forming a CPW structure.

In accordance with another aspect of the present disclosure, there is provided an antenna system for a vehicle, the vehicle including a conductive vehicle body operating as an electrical ground, the vehicle antenna system including: a glass constituting a window of the vehicle; a dielectric substrate that is attached to the glass and configured to form mesh grid-like conductive patterns; and an antenna module implemented as a transparent antenna so as to operate in first to third bands.

In an embodiment, the antenna module may include: a first ground region disposed on one side of a feed line disposed on the dielectric substrate; a radiator region in which a first side and a second side corresponding to the opposite side of the first side form end portions of conductive patterns such that the conductive patterns having different widths are formed in a plurality of step structures; and a second ground region disposed on the other side of the feed line.

In an embodiment, the first ground region may be formed to have a length greater than or equal to that of the second ground region in one axial direction, and the number of steps on the second side may be greater than or equal to the number of steps on the first side.

In an embodiment, at least part of the first side formed by the conductive patterns of the radiator region may be formed in a liner structure, and the second side in the radiator region may form a plurality of step structures by the conductive patterns having different widths.

In an embodiment, the radiator region, the first ground region, and the second ground region may constitute an antenna module, and the antenna system may further include: a transceiver circuit operably coupled to the antenna module through the feed line, that controls the antenna module so that a radio signal in at least one of first to third bands is radiated through the antenna module; and a processor operably coupled to the transceiver circuit, and configured to control the transceiver circuit.

In an embodiment, the processor may be configured to perform carrier aggregation CA or dual connectivity DC through a first antenna element and a second antenna element of the antenna module, by controlling the transceiver circuit so that radio signals of different bands are applied to the feed line.

Advantageous Effects of Invention

Technical effects of a wideband antenna disposed at a vehicle will be described as follows.

In some implementations, an antenna made of a transparent material that operates in a wideband range and can provide LTE and 5G communication services can be provided by forming a first slot inside a first patch and a second slot in a second patch.

In some implementations, a transparent antenna made of a transparent material, which has a radiator region including conductive patterns with different widths so as to form multiple resonance points and can operate in a wideband range, can be provided.

In some implementations, an entire size of a transparent antenna and a feeding loss can be minimized by minimizing a length of feed lines.

In some implementations, an antenna structure made of a transparent material that can be minimized in antenna size while operating in a wideband range by employing a CPW feeding structure and a radiator structure, in which ground regions are formed in an asymmetric structure, can be provided.

In some implementations, an antenna structure of a transparent material, which can obtain improved antenna efficiency and transparency while operating in a wideband range by implementing conductive patterns in a metal mesh structure and defining a dummy pattern even at a dielectric region, can be provided.

In some implementations, a structure, in which an antenna structure made of a transparent material with improved antenna efficiency while operating in a wideband range can be disposed at various positions, such as an upper, lower, or side region of a front window of a vehicle, can be provided.

In some implementations, communication performance can be improved by arranging a plurality of transparent antennas on glass of a vehicle or a display of an electronic device.

Further scope of applicability of the present disclosure will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

MODE FOR THE INVENTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

An antenna system described herein may be mounted on a vehicle. Configurations and operations according to implementations may also be applied to a communication system, namely, antenna system mounted on a vehicle. In this regard, the antenna system mounted on the vehicle may include a plurality of antennas, and a transceiver circuit and a processor for controlling the plurality of antennas.

Figure 1A:
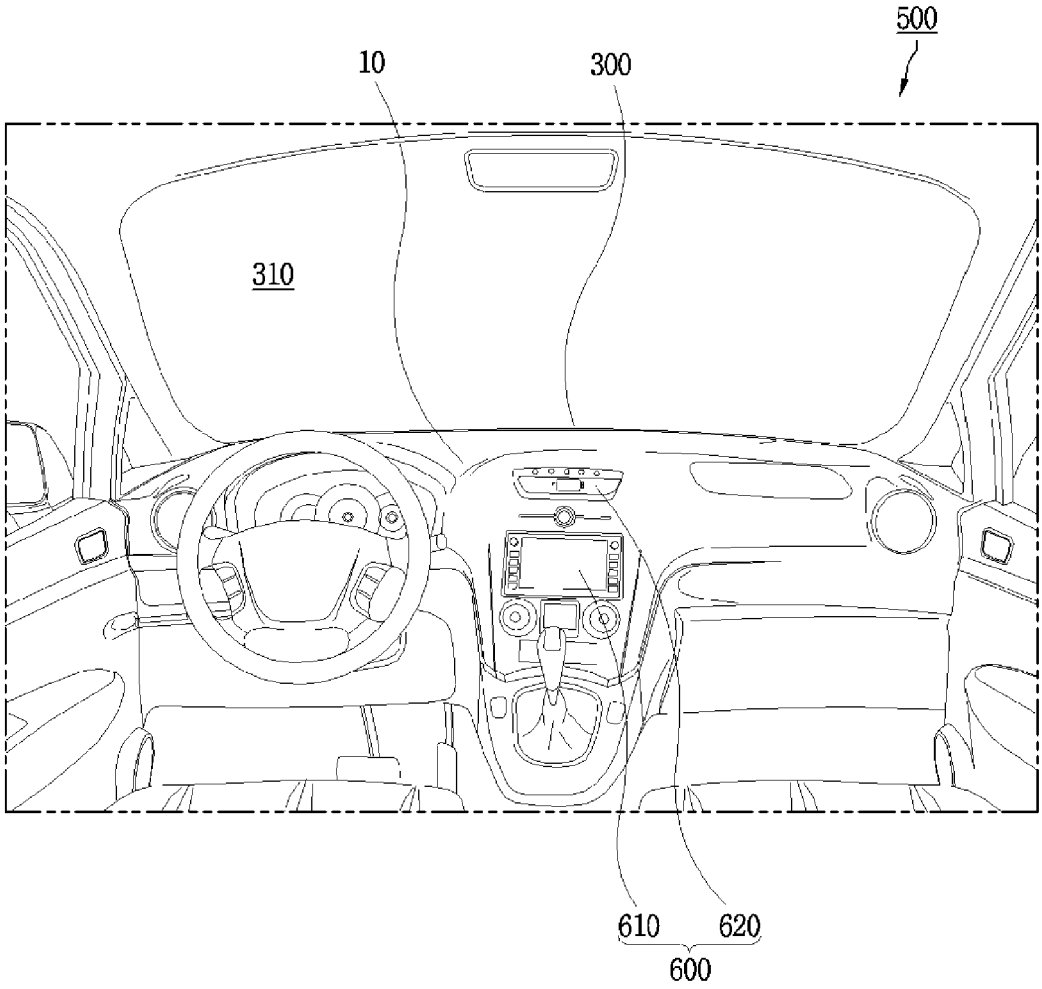
FIG. 1A is a diagram illustrating a vehicle interior in accordance with one example.
Figure 1B:
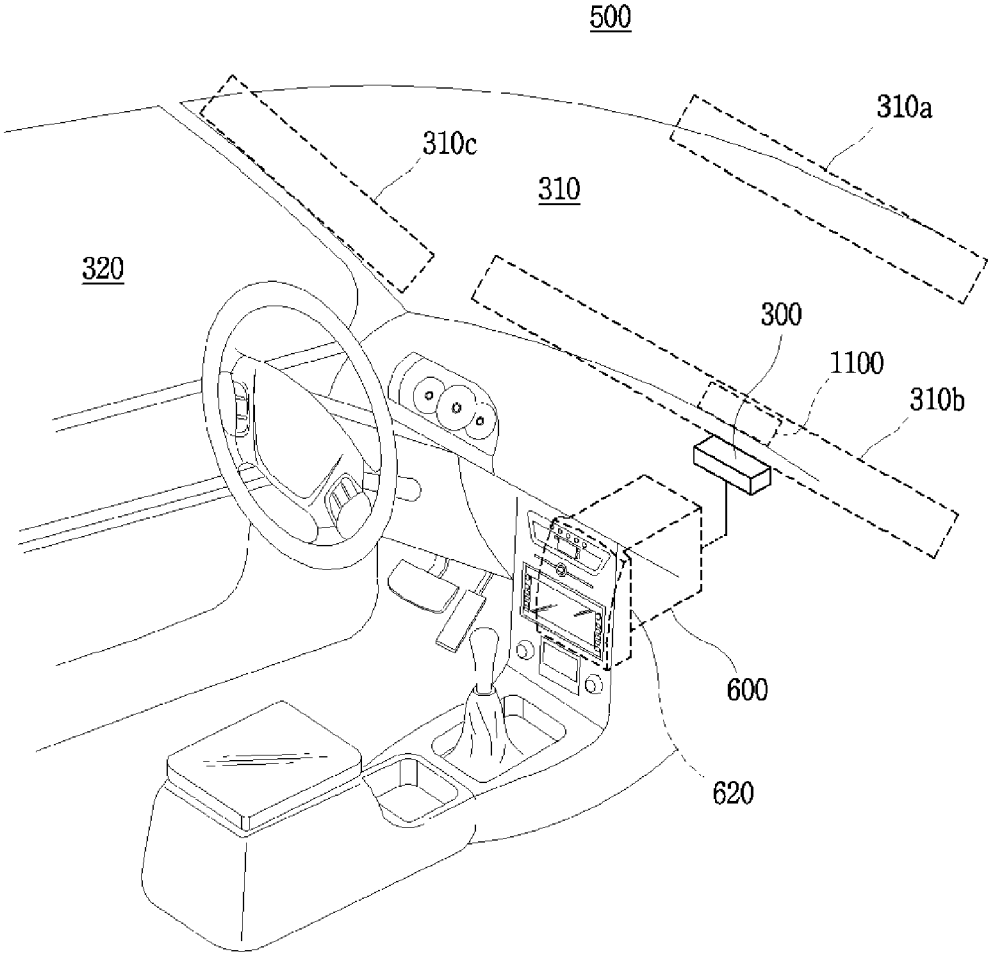
FIG. 1B is a lateral view illustrating the vehicle interior in accordance with the one example.

FIG. 1A is a diagram illustrating a vehicle interior in accordance with one example. FIG. 1B is a lateral view illustrating the vehicle interior in accordance with the one example.

As illustrated in FIGS. 1A and 1B, the present disclosure describes an antenna unit (i.e., an internal antenna system) 1000 capable of transmitting and receiving signals through GPS, 4G wireless communication, 5G wireless communication, Bluetooth, or wireless LAN. Therefore, the antenna unit (i.e., the antenna system) 1000 capable of supporting these various communication protocols may be referred to as an integrated antenna module 1000. The antenna system 1000 may include a telematics control unit (TCU) 300 and an antenna assembly 1100. For example, the antenna assembly 1100 may be disposed on a window of a vehicle.

The present disclosure also describes a vehicle 500 having the antenna system 1000. The vehicle 500 may include a dashboard and a housing 10 including the telematics control unit (TCU) 300, and the like. In addition, the vehicle 500 may include a mounting bracket for mounting the telematics control unit (TCU) 300.

The vehicle 500 may include the telematics control unit (TCU) 300 and an infotainment unit 600 configured to be connected to the telematics control unit 300. A portion of a front pattern of the infotainment unit 600 may be implemented in the form of a dashboard of the vehicle. A display 610 and an audio unit 620 may be included in the dashboard of the vehicle.

The antenna assembly 1100, namely, the antenna module 1100 in the form of a transparent antenna may be disposed at at least one of an upper region 310*a*, a lower region 310*b*, and a side region 310*c* of a front window 310. The antenna assembly 1100 may also be disposed at a side window 320, which is disposed at a side surface of the vehicle, in addition to the front window 310.

As illustrated in FIG. 1B, when the antenna assembly 1100 is disposed at the lower region 310*b* of the front window 310, it may be operably coupled to a TCU 300 disposed inside the vehicle. When the antenna assembly 1100 is disposed at the upper region 310*a* or the side region 310*c* of the front window 310, it may be operably coupled to a TCU disposed outside the vehicle. However, the present disclosure may not be limited to the TCU coupling configuration inside or outside the vehicle.

<V2X (Vehicle-to-Everything)>

V2X communication may include communications between a vehicle and all entities, such as V2V (Vehicle-to-Vehicle) which refers to communication between vehicles, V2I (Vehicle-to-Infrastructure) which refers to communication between a vehicle and an eNB or RSU (Road Side Unit), V2P (Vehicle-to-Pedestrian) which refers to communication between a vehicle and a terminal possessed by a person (pedestrian, cyclist, vehicle driver, or passenger), V2N (vehicle-to-network), and the like.

V2X communication may indicate the same meaning as V2X sidelink or NR V2X or may indicate a broader meaning including V2X sidelink or NR V2X.

V2X communication can be applied to various services, for example, forward collision warning, automatic parking system, Cooperative Adaptive Cruise Control (CACC), control loss warning, traffic queue warning, traffic vulnerable safety warning, emergency vehicle warning, speed warning when driving on a curved road, traffic flow control, and the like.

V2X communication may be provided through a PC5 interface and/or a Uu interface. In this case, specific network entities for supporting communications between a vehicle and all entities may exist in a wireless communication system supporting V2X communication. For example, the network entity may include a base station (eNB), a Road Side Unit (RSU), a terminal, or an application server (e.g., a traffic safety server).

In addition, a terminal performing V2X communication may refer to not only a general handheld UE but also a vehicle (V-UE), a pedestrian UE, an RSU of an eNB type, an RSU of a UE type, a robot equipped with a communication module, and the like.

V2X communication may be performed directly between terminals or may be performed through the network entity (entities). V2X operation modes may be classified according to a method of performing such V2X communication.

Terms used in V2X communication may be defined as follows.

A Road Side Unit (RSU) is a V2X service enabled device that can transmit and receive data to and from a moving vehicle using V2I service. The RSU is also a stationary infrastructure entity supporting V2X application programs, and can exchange messages with other entities that support V2X application programs. The RSU is a term frequently used in existing ITS specifications, and the reason for introducing this term to the 3GPP specifications is to make the documents easier to read for the ITS industry. The RSU is a logical entity that combines a V2X application logic with the functionality of an eNB (referred to as an eNB-type RSU) or a UE (referred to as a UE-type RSU).

V2I Service is a type of V2X service, where one party is a vehicle whereas the other party is an entity belonging to infrastructure. V2P Service is also a type of V2X service, where one party is a vehicle and the other party is a device carried by an individual (e.g., a handheld terminal carried by a pedestrian, a cyclist, a driver, or a passenger). V2X Service is a type of 3GPP communication service that involves a transmitting or receiving device on a vehicle. Based on the other party involved in the communication, it may be further divided into V2V service, V2I service and V2P service.

V2X enabled UE is a UE that supports V2X service. V2V Service is a type of V2X service, where both parties of communication are vehicles. V2V communication range is a direct communication range between two vehicles engaged in V2V service.

Figure 2A:
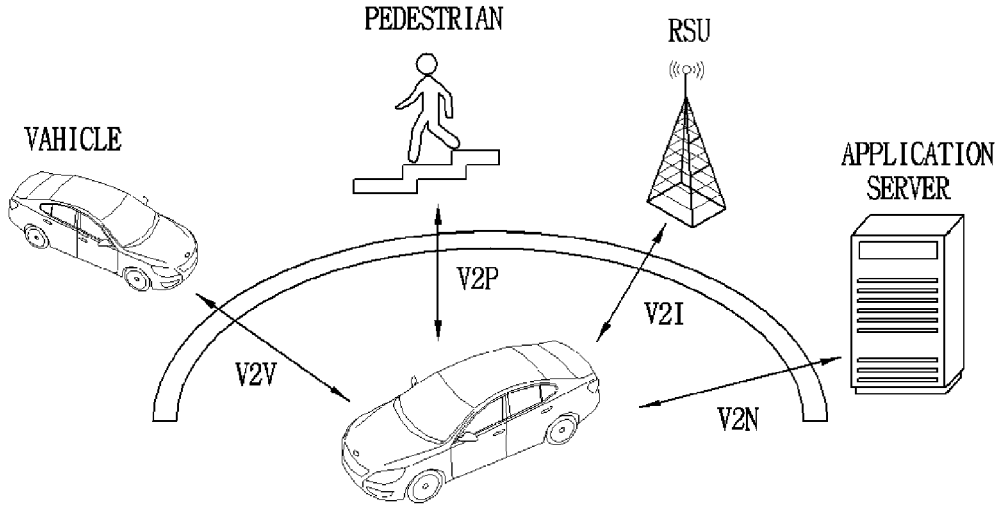
FIG. 2A is a view illustrating a type of V2X application.

V2X applications, referred to as Vehicle-to-Everything (V2X), include the four different types, as described above, namely, (1) vehicle-to-vehicle (V2V), (2) vehicle-to-infrastructure (V2I), (3) vehicle-to-network (V2N), (4) vehicle-to-pedestrian (V2P). FIG. 2A is a view illustrating a type of V2X application. Referring to FIG. 2A, the four types of V2X applications may use "cooperative awareness" to provide more intelligent services for end-users.

This means that entities, such as vehicles, roadside infrastructures, application servers and pedestrians, may collect knowledge of their local environments (e.g., information received from other vehicles or sensor equipment in proximity) to process and share that knowledge in order to provide more intelligent services, such as cooperative collision warning or autonomous driving.

<NR V2X>

Support for V2V and V2X services has been introduced in LTE during Releases 14 and 15, in order to expand the 3GPP platform to the automotive industry.

Requirements for support of enhanced V2X use cases are broadly arranged into four use case groups.

(1) Vehicles Platooning enables the vehicles to dynamically form a platoon traveling together. All the vehicles in the platoon obtain information from the leading vehicle to manage this platoon. These information allow the vehicles to drive closer than normal in a coordinated manner, going to the same direction and traveling together.

(2) Extended Sensors enable the exchange of raw or processed data gathered through local sensors or live video images among vehicles, road site units, devices of pedestrians and V2X application servers. The vehicles can increase the perception of their environment beyond of what their own sensors can detect and have a more broad and holistic view of the local situation. High data rate is one of the key characteristics.

(3) Advanced Driving enables semi-automated or full-automated driving. Each vehicle and/or RSU shares its own perception data obtained from its local sensors with vehicles in proximity and allows vehicles to synchronize and coordinate their trajectories or maneuvers. Each vehicle shares its driving intention with vehicles in proximity too.

(4) Remote Driving enables a remote driver or a V2X application to operate a remote vehicle for those passengers who cannot drive by themselves or remote vehicles located in dangerous environments. For a case where variation is limited and routes are predictable, such as in public transportation, driving based on cloud computing can be used. High reliability and low latency are the main requirements.

A description to be given below can be applied to all of NR SL (sidelink) and LTE SL, and when no radio access technology (RAT) is indicated, the NR SL is meant. Operation scenarios considered in NR V2X may be categorized into six as follows. In this regard, FIG. 2B illustrates a standalone scenario supporting V2X SL communication and an MR-DC scenario supporting V2X SL communication.

In particular, 1) in scenario 1, a gNB provides control/configuration for a UE's V2X communication in both LTE SL and NR SL. 2) In scenario 2, an ng-eNB provides control/configuration for a UE's V2X communication in both LTE SL and NR SL. 3) In scenario 3, an eNB provides control/configuration fora UE's V2X communication in both LTE SL and NR SL. On the other hand, 4) in scenario 4, a UE's V2X communication in LTE SL and NR SL is controlled/configured by Uu while the UE is configured with EN-DC. 5) In scenario 5, a UE's V2X communication in LTE SL and NR SL is controlled/configured by Uu while the UE is configured in NE-DC. 6) In scenario 6, a UE's V2X communication in LTE SL and NR SL is controlled/configured by Uu while the UE is configured in NGEN-DC.

Figure 2B:
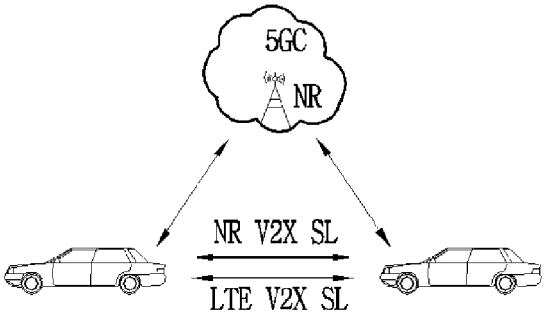
FIG. 2B is a view illustrating a standalone scenario supporting V2X SL communication and an MR-DC scenario supporting V2X SL communication.
Figure 2B:
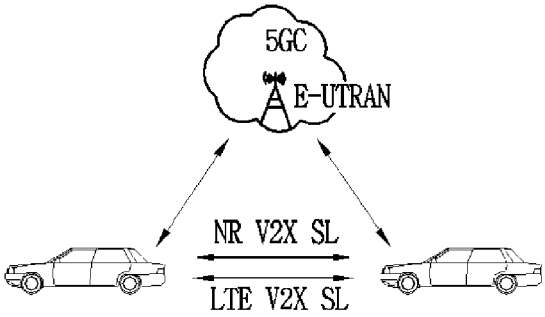
Figure 2B:
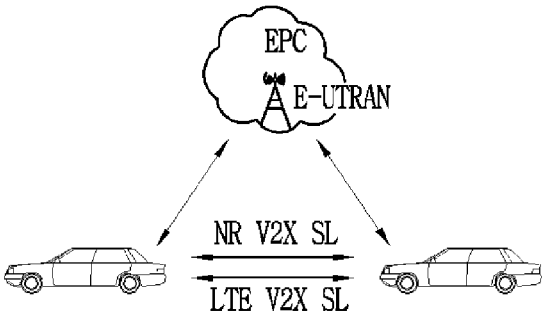
Figure 2B:
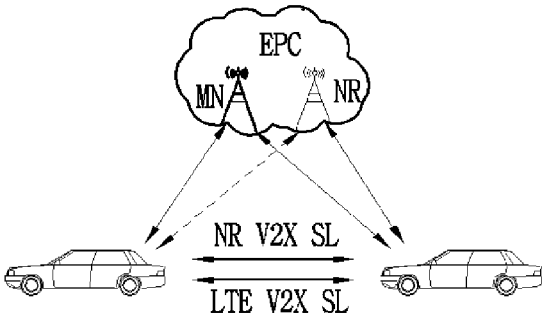
Figure 2B:
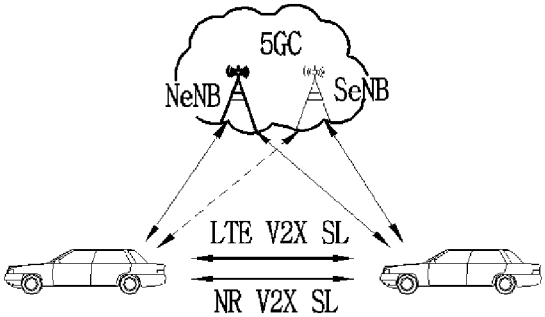
Figure 2B:
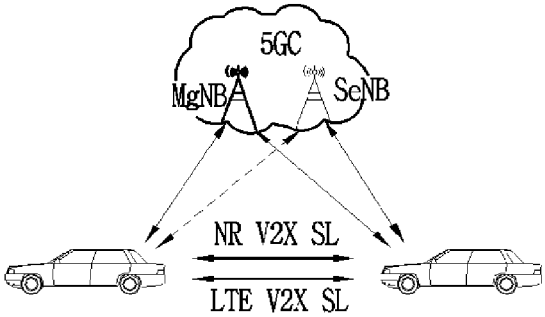

In order to support V2X communication, as illustrated in FIGS. 2A and 2B, a vehicle may perform wireless communication with an eNB and/or a gNB through an antenna system. The antenna system may be configured as an internal antenna system as illustrated in FIGS. 1A and 1B. The antenna system may alternatively be implemented as an external antenna system and/or an internal antenna system as illustrated in FIGS. 3A to 3C.

Figure 3A:
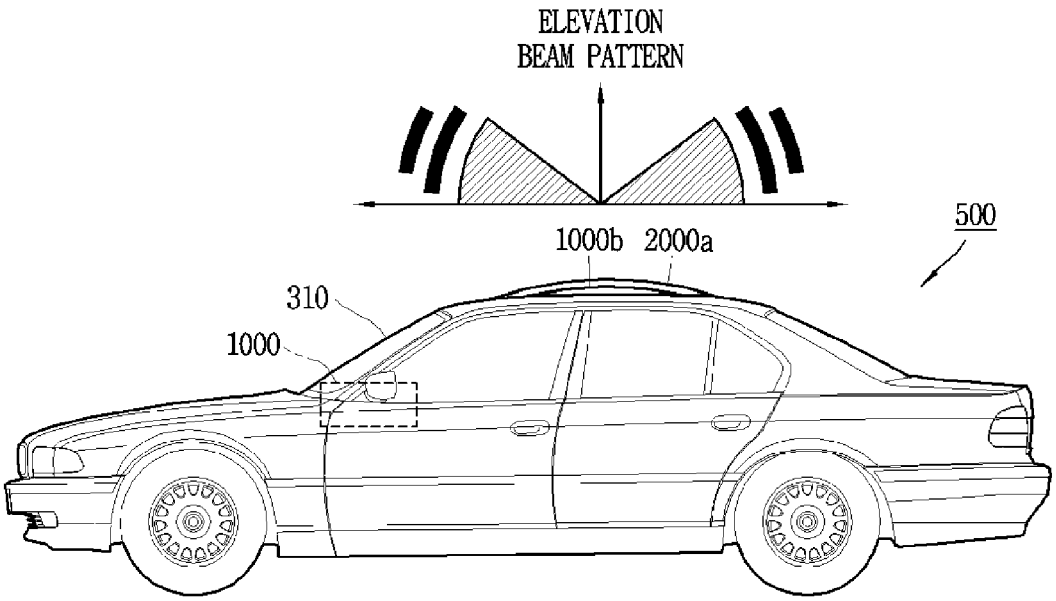
FIGS. 3A to 3C are views illustrating an example of a structure for mounting an antenna system on a vehicle, which includes the antenna system mounted on the vehicle.
Figure 3B:
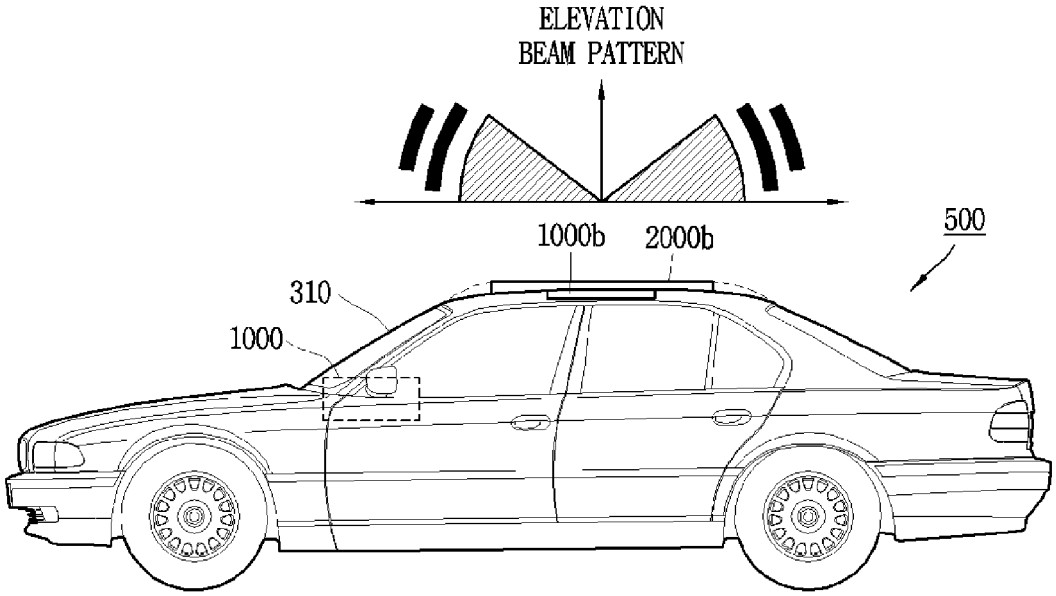
Figure 3C:
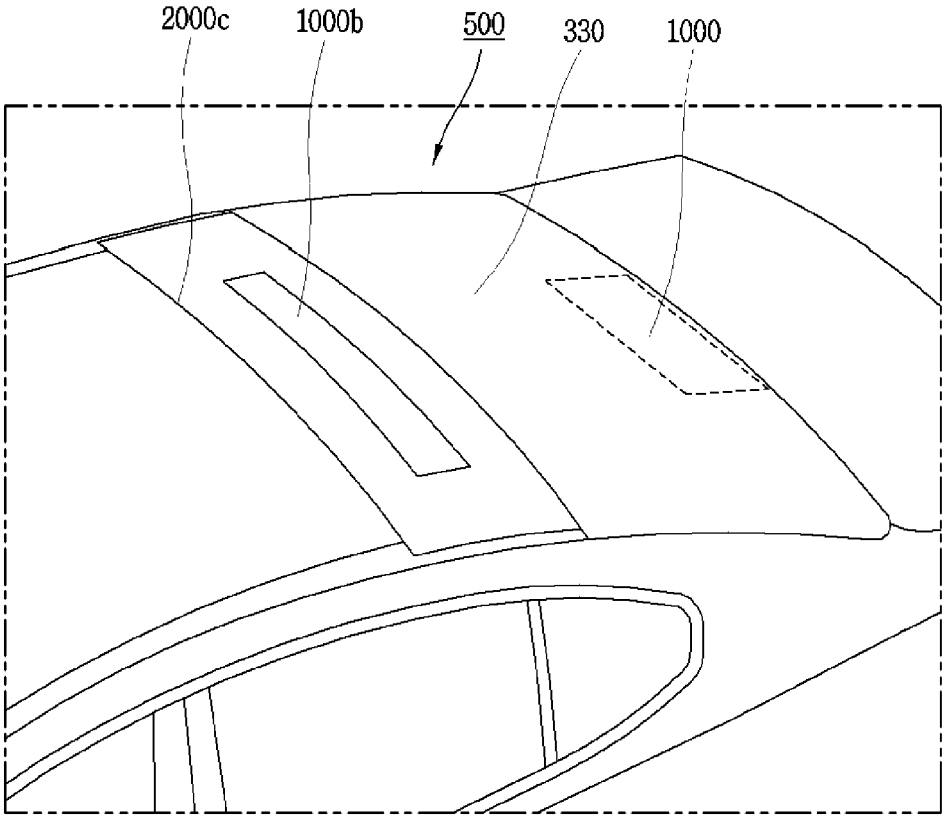

FIGS. 3A to 3C are views illustrating an example of a structure for mounting an antenna system on a vehicle, which includes the antenna system mounted on the vehicle. In this regard, FIGS. 3A to 3C illustrate a configuration capable of performing wireless communication through a transparent antenna disposed on the front window 310 of the vehicle. An antenna system 1000 including a transparent antenna may be disposed on a front window of a vehicle and inside the vehicle. Wireless communication may also be performed through a transparent antenna disposed on a side glass of the vehicle, in addition to the front window.

The antenna system for the vehicle that includes the transparent antenna can be combined with other antennas. Referring to FIGS. 3A to 3C, in addition to the antenna system 1000 implemented as the transparent antenna, a separate antenna system 1000*b* may be further configured. FIGS. 3A and 3B illustrate a structure in which the antenna system 1000*b*, in addition to the antenna system 1000, is mounted on or in a roof of the vehicle. On the other hand, FIG. 3C illustrates a structure in which the separate antenna system 1000*b*, in addition to the antenna system 1000, is mounted in a roof frame of a roof and a rear mirror of the vehicle.

Referring to FIGS. 3A to 3C, in order to improve the appearance of the vehicle and to maintain a telematics performance at the time of collision, an existing shark fin antenna may be replaced with a flat antenna of a non-protruding shape. In addition, the present disclosure proposes an integrated antenna of an LTE antenna and a 5G antenna considering fifth generation (5G) communication while providing the existing mobile communication service (e.g., LTE).

Referring to FIG. 3A, the antenna system 1000 implemented as the transparent antenna may be disposed on the front window 310 of the vehicle and inside the vehicle. The second antenna system 1000*b* corresponding to an external antenna may be disposed on the roof of the vehicle. In FIG. 3A, a radome 2000*a* may cover the second antenna system 1000*b* to protect the second antenna system 1000*b* from an external environment and external impacts while the vehicle travels. The radome 2000*a* may be made of a dielectric material through which radio signals are transmitted/received between the second antenna system 1000*b* and a base station.

Referring to FIG. 3B, the antenna system 1000 implemented as the transparent antenna may be disposed on the front window 310 of the vehicle and inside the vehicle. One the other hand, the second antenna system 1000*b* corresponding to the external antenna may be disposed within a roof structure of the vehicle and at least part of the roof structure 2000*b* may be made of a non-metallic material. At this time, the roof structure 2000*b* of the vehicle except for the at least part made of the non-metallic material may be made of a dielectric material through which radio signals are transmitted/received between the antenna system 1000*b* and the base station.

Referring to FIG. 3C, the antenna system 1000 implemented as the transparent antenna may be disposed on the rear window 330 of the vehicle and inside the vehicle. The second antenna system 1000*b* corresponding to the external antenna may be disposed within the roof frame 2000*c* of the vehicle, and at least part of the roof frame 2000*c* may be made of a non-metallic material. At this time, the roof frame 2000*c* of the vehicle 500 except for the at least part made of the non-metallic material may be made of a dielectric material through which radio signals are transmitted/received between the second antenna system 1000*b* and the base station.

Referring to FIGS. 3A to 3C, antennas provided in the antenna system 1000 mounted on the vehicle may form a beam pattern in a direction perpendicular to the front window 310 or the rear window 330. Antenna provided in the second antenna system 1000 mounted on the vehicle may further define a beam coverage by a predetermined angle in a horizontal region with respect to the vehicle body.

Meanwhile, the vehicle 500 may include only the antenna unit (i.e., the internal antenna system) 1000 corresponding to the internal antenna without the antenna system 1000*b* corresponding to the external antenna.

Figure 4:
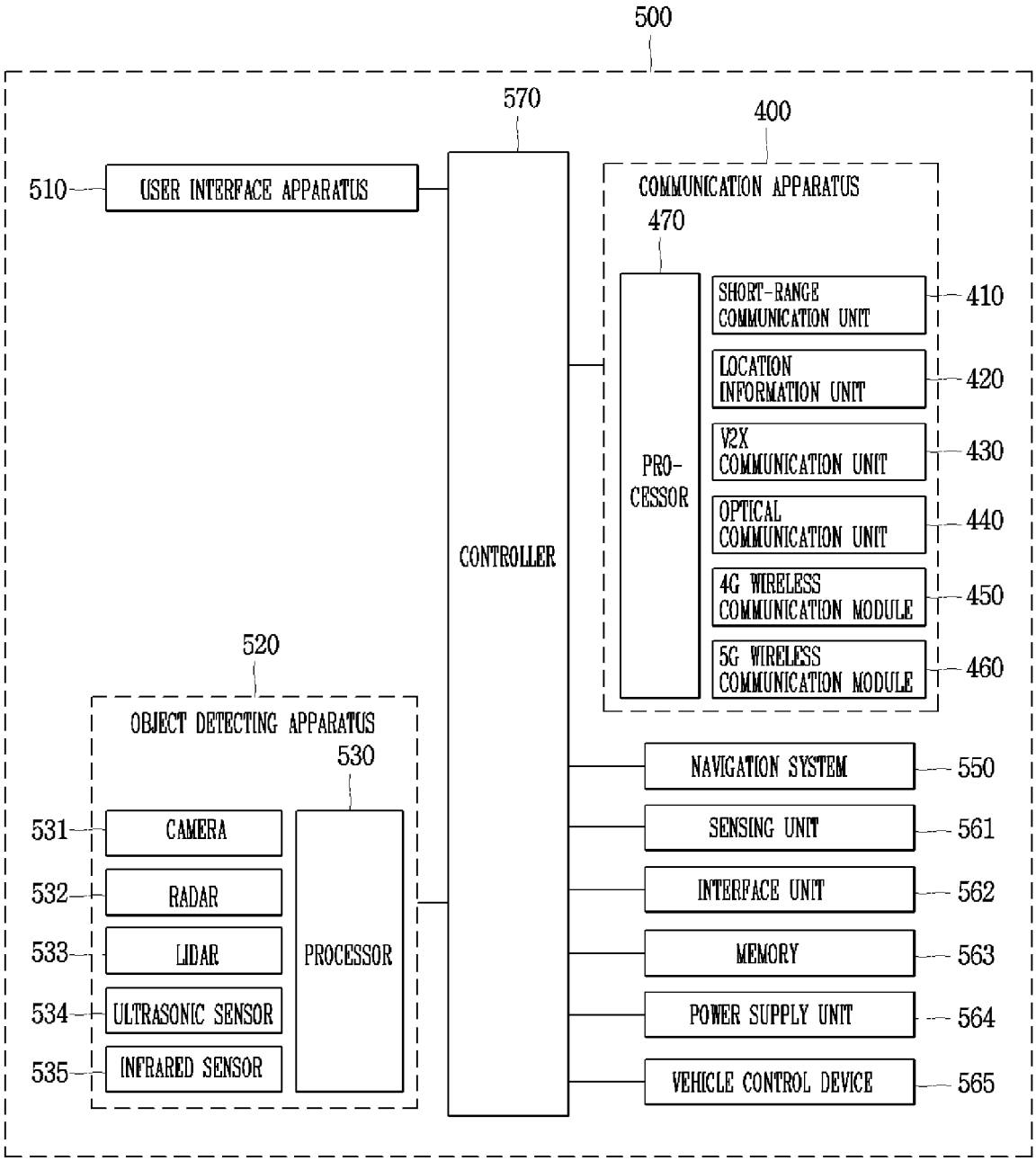
FIG. 4 is a block diagram illustrating a vehicle and an antenna system mounted to the vehicle in accordance with one example.

Meanwhile, FIG. 4 is a block diagram illustrating a vehicle and an antenna system mounted on the vehicle in accordance with an implementation.

The vehicle 500 may be an autonomous vehicle. The vehicle 500 may be switched into an autonomous driving mode or a manual mode (a pseudo driving mode) based on a user input. For example, the vehicle 500 may be switched from the manual mode into the autonomous mode or from the autonomous mode into the manual mode based on a user input received through a user interface apparatus 510.

In relation to the manual mode and the autonomous driving mode, operations such as object detection, wireless communication, navigation, and operations of vehicle sensors and interfaces may be performed by the telematics control unit mounted on the vehicle 500. Specifically, the telematics control unit mounted on the vehicle 500 may perform the operations in cooperation with the antenna module 300, the object detecting apparatus 520, and other interfaces. In some examples, the communication apparatus 400 may be disposed in the telematics control unit separately from the antenna system 300 or may be disposed in the antenna system 300.

The vehicle 500 may be switched into the autonomous driving mode or the manual mode based on driving environment information. The driving environment information may be generated based on object information provided from the object detecting apparatus 520. For example, the vehicle 500 may be switched from the manual mode into the autonomous driving mode or from the autonomous driving mode into the manual mode based on driving environment information generated in the object detecting apparatus 520.

For example, the vehicle 500 may be switched from the manual mode into the autonomous driving mode or from the autonomous driving mode into the manual mode based on driving environment information received through the communication apparatus 400. The vehicle 500 may be switched from the manual mode into the autonomous driving mode or from the autonomous driving mode into the manual mode based on information, data or signal provided from an external device.

When the vehicle 500 is driven in the autonomous driving mode, the autonomous vehicle 500 may be driven based on an operation system. For example, the autonomous vehicle 500 may be driven based on information, data or signal generated in a driving system, a parking exit system, and a parking system. When the vehicle 500 is driven in the manual mode, the autonomous vehicle 500 may receive a user input for driving through a driving control apparatus. The vehicle 500 may be driven based on the user input received through the driving control apparatus.

The vehicle 500 may include a user interface apparatus 510, an object detecting apparatus 520, a navigation system 550, and a communication apparatus 400. In addition, the vehicle may further include a sensing unit 561, an interface unit 562, a memory 563, a power supply unit 564, and a vehicle control device 565 in addition to the aforementioned apparatuses and devices. In some implementations, the vehicle 500 may include more components in addition to components to be explained in this specification or may not include some of those components to be explained in this specification.

The user interface apparatus 510 may be an apparatus for communication between the vehicle 500 and a user. The user interface apparatus 510 may receive a user input and provide information generated in the vehicle 500 to the user. The vehicle 510 may implement user interfaces (UIs) or user experiences (UXs) through the user interface apparatus 200.

The object detecting apparatus 520 may be an apparatus for detecting an object located at outside of the vehicle 500. The object may be a variety of objects associated with driving (operation) of the vehicle 500. In some examples, objects may be classified into moving objects and fixed (stationary) objects. For example, the moving objects may include other vehicles and pedestrians. The fixed objects may include traffic signals, roads, and structures, for example. The object detecting apparatus 520 may include a camera 521, a radar 522, a LiDAR 523, an ultrasonic sensor 524, an infrared sensor 525, and a processor 530. In some implementations, the object detecting apparatus 520 may further include other components in addition to the components described, or may not include some of the components described.

The processor 530 may control an overall operation of each unit of the object detecting apparatus 520. The processor 530 may detect an object based on an acquired image, and track the object. The processor 530 may execute operations, such as a calculation of a distance from the object, a calculation of a relative speed with the object and the like, through an image processing algorithm.

In some implementations, the object detecting apparatus 520 may include a plurality of processors 530 or may not include any processor 530. For example, each of the camera 521, the radar 522, the LiDAR 523, the ultrasonic sensor 524 and the infrared sensor 525 may include the processor in an individual manner.

When the processor 530 is not included in the object detecting apparatus 520, the object detecting apparatus 520 may operate according to the control of a processor of an apparatus within the vehicle 500 or the controller 570.

The navigation system 550 may provide location information related to the vehicle based on information obtained through the communication apparatus 400, in particular, a location information unit 420. Also, the navigation system 550 may provide a path (or route) guidance service to a destination based on current location information related to the vehicle. In addition, the navigation system 550 may provide guidance information related to surroundings of the vehicle based on information obtained through the object detecting apparatus 520 and/or a V2X communication unit 430. In some examples, guidance information, autonomous driving service, etc. may be provided based on V2V, V2I, and V2X information obtained through a wireless communication unit operating together with the antenna system 1000.

The communication apparatus 400 may be an apparatus for performing communication with an external device. Here, the external device may be another vehicle, a mobile terminal, or a server. The communication apparatus 400 may perform the communication by including at least one of a transmitting antenna, a receiving antenna, and radio frequency (RF) circuit and RF device for implementing various communication protocols. The communication apparatus 400 may include a short-range communication unit 410, a location information unit 420, a V2X communication unit 430, an optical communication unit 440, a broadcast transceiver 450 and a processor 470. In some implementations, the communication apparatus 400 may further include other components in addition to the components described, or may not include some of the components described.

The short-range communication unit 410 is a unit for facilitating short-range communications. The short-range communication unit 410 may construct short-range wireless area networks to perform short-range communication between the vehicle 500 and at least one external device. The location information unit 420 may be a unit for acquiring location information related to the vehicle 500. For example, the location information unit 420 may include a Global Positioning System (GPS) module or a Differential Global Positioning System (DGPS) module.

The V2X communication unit 430 may be a unit for performing wireless communication with a server (Vehicle to Infrastructure; V2I), another vehicle (Vehicle to Vehicle; V2V), or a pedestrian (Vehicle to Pedestrian; V2P). The V2X communication unit 430 may include an RF circuit implementing communication protocols such as V2I, V2V, and V2P. The optical communication unit 440 may be a unit for performing communication with an external device through the medium of light. The optical communication unit 440 may include a light-emitting diode for converting an electric signal into an optical signal and sending the optical signal to the exterior, and a photodiode for converting the received optical signal into an electric signal. In some implementations, the light-emitting diode may be integrated with lamps provided on the vehicle 500.

The wireless communication unit 460 is a unit that performs wireless communications with one or more communication systems through one or more antenna systems. The wireless communication unit 460 may transmit and/or receive a signal to and/or from a device in a first communication system through a first antenna system. In addition, the wireless communication unit 460 may transmit and/or receive a signal to and/or from a device in a second communication system through a second antenna system. For example, the first communication system and the second communication system may be an LTE communication system and a 5G communication system, respectively. However, the first communication system and the second communication system may not be limited thereto, and may be changed according to applications.

In some examples, the antenna module 300 disposed in the vehicle 500 may include a wireless communication unit. In this regard, the vehicle 500 may be an electric vehicle (EV) or a vehicle that can be connected to a communication system independently of an external electronic device. In this regard, the communication apparatus 400 may include at least one of the short-range communication unit 410, the location information unit 420, the V2X communication unit 430, the optical communication unit 440, a 4G wireless communication module 450, and a 5G wireless communication module 460.

The 4G wireless communication module 450 may perform transmission and reception of 4G signals with a 4G base station through a 4G mobile communication network. In this case, the 4G wireless communication module 450 may transmit at least one 4G transmission signal to the 4G base station. In addition, the 4G wireless communication module 450 may receive at least one 4G reception signal from the 4G base station. In this regard, Uplink (UL) Multi-input and Multi-output (MIMO) may be performed by a plurality of 4G transmission signals transmitted to the 4G base station. In addition, Downlink (DL) MIMO may be performed by a plurality of 4G reception signals received from the 4G base station.

The 5G wireless communication module 460 may perform transmission and reception of 5G signals with a 5G base station through a 5G mobile communication network. Here, the 4G base station and the 5G base station may have a Non-Stand-Alone (NSA) structure. The 4G base station and the 5G base station may be disposed in the Non-Stand-Alone (NSA) structure. Alternatively, the 5G base station may be disposed in a Stand-Alone (SA) structure at a separate location from the 4G base station. The 5G wireless communication module 460 may perform transmission and reception of 5G signals with a 5G base station through a 5G mobile communication network. In this case, the 5G wireless communication module 460 may transmit at least one 5G transmission signal to the 5G base station. In addition, the 5G wireless communication module 460 may receive at least one 5G reception signal from the 5G base station. In this instance, 5G and 4G networks may use the same frequency band, and this may be referred to as LTE refarming. In some examples, a Sub 6 frequency band, which is a range of 6 GHz or less, may be used as the 5G frequency band. On the other hand, a millimeter-wave (mmWave) range may be used as the 5G frequency band to perform wideband high-speed communication. When the mmWave band is used, the electronic device may perform beamforming for communication coverage expansion with a base station.

On the other hand, regardless of the 5G frequency band, 5G communication systems can support a larger number of multi-input multi-output (MIMO) to improve a transmission rate. In this instance, UL MIMO may be performed by a plurality of 5G transmission signals transmitted to a 5G base station. In addition, DL MIMO may be performed by a plurality of 5G reception signals received from the 5G base station.

In some examples, the wireless communication unit 110 may be in a Dual Connectivity (DC) state with the 4G base station and the 5G base station through the 4G wireless communication module 450 and the 5G wireless communication module 460. As such, the dual connectivity with the 4G base station and the 5G base station may be referred to as EUTRAN NR DC (EN-DC). On the other hand, if the 4G base station and 5G base station are disposed in a co-located structure, throughput improvement can be achieved by inter-Carrier Aggregation (inter-CA). Accordingly, when the 4G base station and the 5G base station are disposed in the EN-DC state, the 4G reception signal and the 5G reception signal may be simultaneously received through the 4G wireless communication module 450 and the 5G wireless communication module 460. Short-range communication between electronic devices (e.g., vehicles) may be performed using the 4G wireless communication module 450 and the 5G wireless communication module 460. In some implementations, after resources are allocated, vehicles may perform wireless communication in a V2V manner without a base station.

Meanwhile, for transmission rate improvement and communication system convergence, Carrier Aggregation (CA) may be carried out using at least one of the 4G wireless communication module 450 and the 5G wireless communication module 460 and a WiFi communication module. In this regard, 4G+WiFi CA may be performed using the 4G wireless communication module 450 and the Wi-Fi communication module. Or, 5G+WiFi CA may be performed using the 5G wireless communication module 460 and the Wi-Fi communication module.

In some examples, the communication apparatus 400 may implement a display apparatus for a vehicle together with the user interface apparatus 510. In this instance, the display apparatus for the vehicle may be referred to as a telematics apparatus or an Audio Video Navigation (AVN) apparatus.

Hereinafter, an antenna assembly (antenna module) that may be disposed on a window of a vehicle according to the present disclosure and an antenna system for a vehicle including the antenna assembly will be described. In this regard, the antenna assembly may refer to a structure in which conductive patterns are combined on a dielectric substrate, and may also be referred to as an antenna module.

Figure 5:
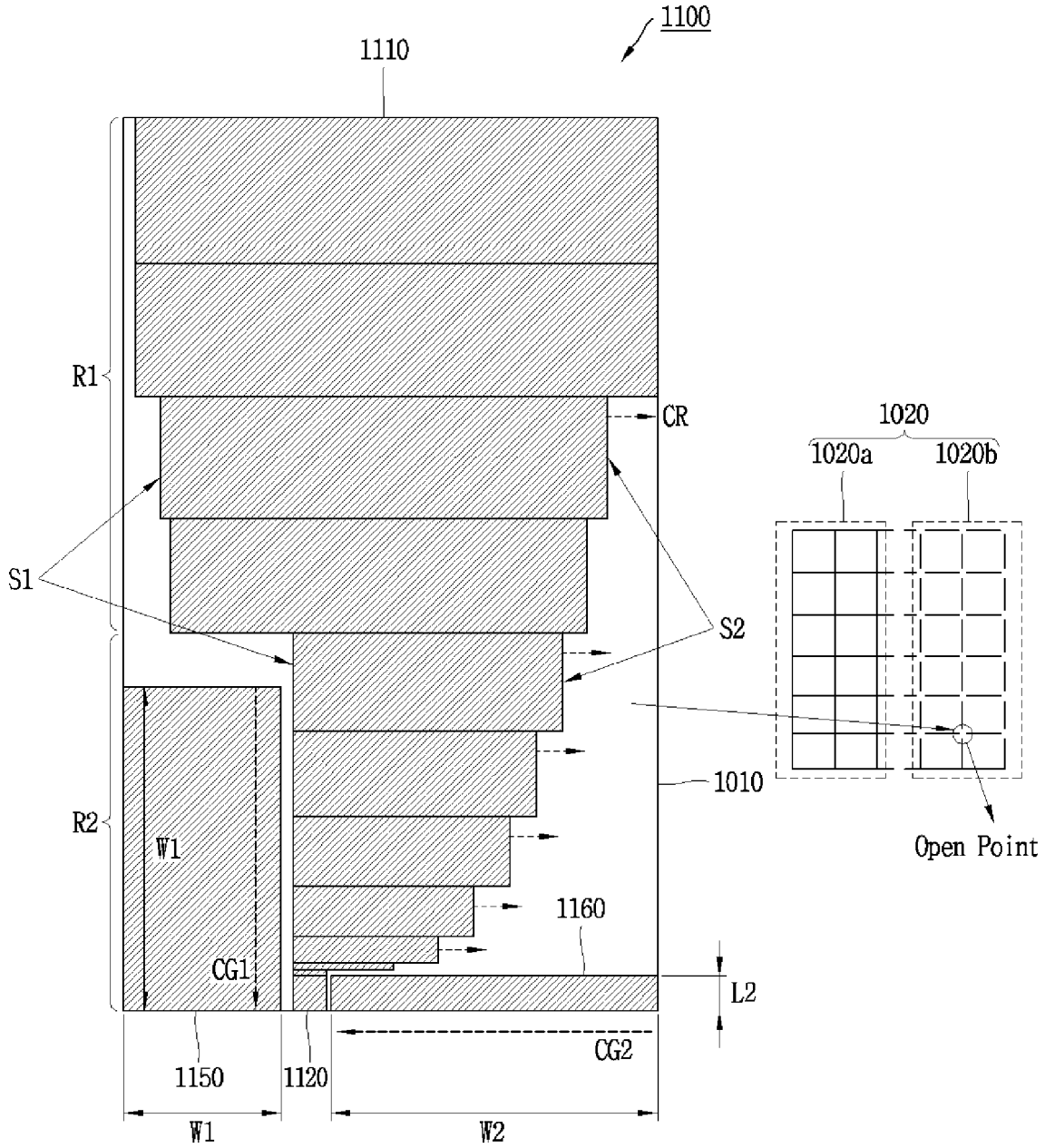
FIG. 5 depicts a broadband CPW antenna assembly configuration according to an embodiment of the present disclosure.

In relation to this, FIG. 5 depicts an antenna assembly (antenna module) that may be disposed on a window of a vehicle according to the present disclosure and an antenna system for a vehicle having an antenna assembly. Meanwhile, FIG. 6 depicts a broadband CPW antenna assembly configuration according to another embodiment of the present disclosure.

Figure 6:
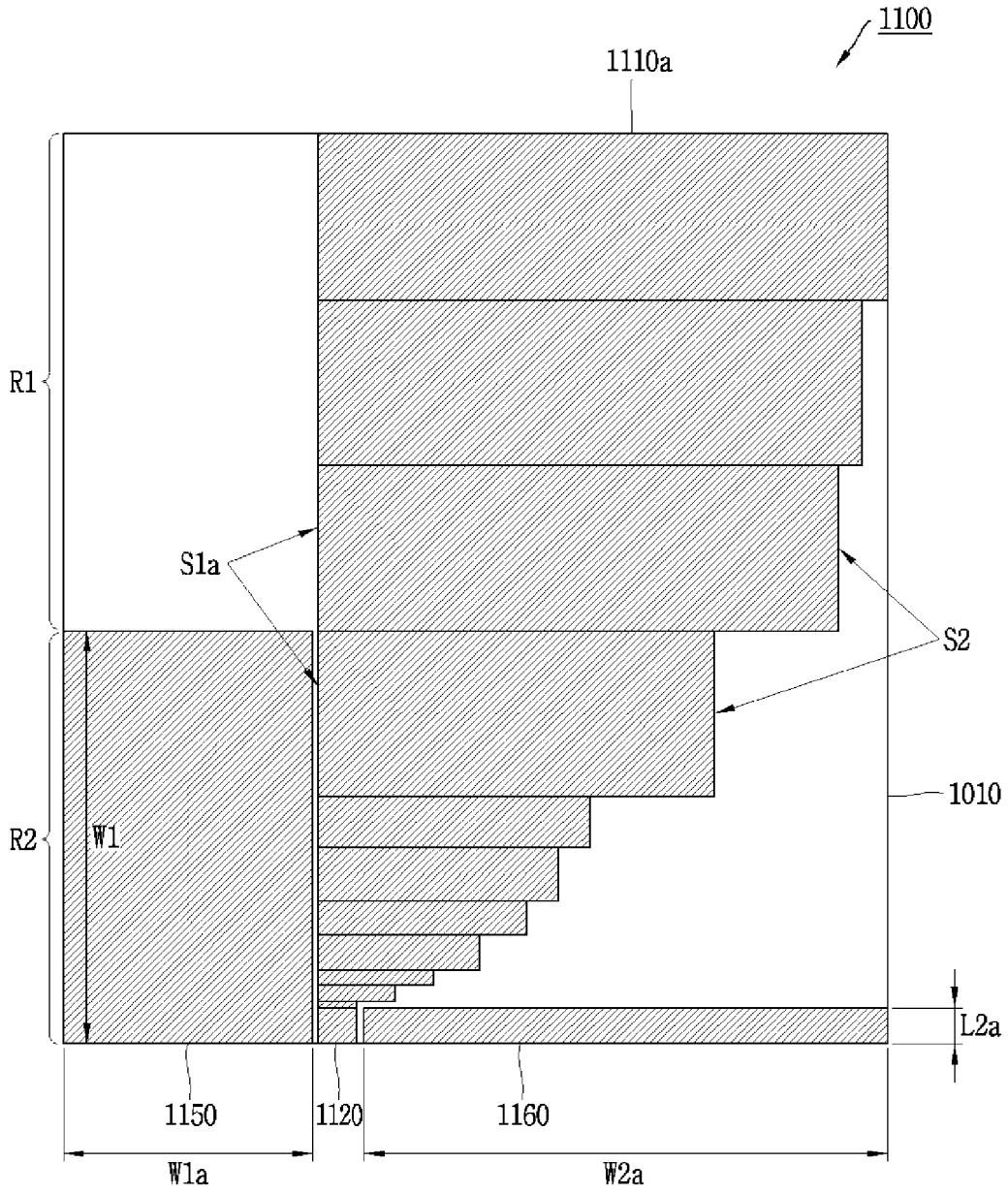
FIG. 6 depicts a broadband CPW antenna assembly configuration according to another embodiment of the present disclosure.

Referring to FIGS. 5 and 6, the broadband CPW antenna assembly may be referred to as an asymmetric CPW antenna because a first ground region 1150 and a second ground region 1160 differ in length and width.

Referring to FIG. 5, the antenna assembly may include a dielectric substrate 1010, a radiator region 1110, a first ground region 1150, and a second ground region 1160.

The first ground region 1150 may be disposed on one side of a feed line 1120 disposed on the dielectric substrate 1010. In the radiator region 1110, a first side S1 and a second side S2 corresponding to the opposite side of the first side S1 may form end portions of conductive patterns such that the conductive patterns having different widths are formed in a plurality of step structures. The second ground region 1160 may be disposed on the other side of the feed line 1120 disposed on the dielectric substrate 1010.

The dielectric substrate 1010 may be configured such that the radiator region 1110, the feed line 1120, the first ground region 1150, and the second ground region 1160 are disposed on a surface thereof. The dielectric substrate 1010 may be implemented as a substrate having a predetermined permittivity and thickness. When the antenna assembly is implemented as a transparent antenna, the dielectric substrate 1010 may be implemented as a transparent substrate made of a transparent material.

The radiator region 1110 may be implemented as conductive patterns on the dielectric substrate 1010 to radiate radio signals. When the antenna assembly is implemented as a transparent antenna, the conductive patterns may be configured as a metal mesh grid 1020*a*. That is, the antenna assembly may be implemented as the metal mesh grid 1020*a* that a plurality of grids are connected to one another. On the other hand, the dummy mesh grid 1020*b* disposed at the dielectric region may be implemented as an open dummy pattern in which a plurality of grids are disconnected at connection points (open points).

The feed line 1120 may be configured to apply a signal on the same plane as the conductive patterns of the radiator region 1110. Accordingly, since the radiator region 1110 and the feed line 1120 are disposed on the same plane, a CPW antenna structure can be implemented.

In the broadband CPW antenna assembly of FIG. 5, the first side S1 of the radiator region 1110 in the first region R1 which is an upper region is formed in a plurality of step structures. On the other hand, the first side S1 of the radiator region 1110 in the second region R2 which is a lower region is formed in a linear structure. Meanwhile, the second side S2 of the radiator region 1110 in the first region R1 which is the upper region and the second region R2 which is the lower region are formed in a plurality of step structures.

The first ground region 1150 may be made longer than the second ground region 1160 in one axial direction. The length L1 of the first ground region 1150 is greater than the length L2 of the second ground region 1160 in one axial direction, that is, the y-axis direction, along which the first region R1 and the second region R2 are separated. Accordingly, an asymmetric CPW structure is formed. On the other hand, the width W1 of the first ground region 1150 may be smaller than the width W2 of the second ground region 1160.

The number of steps on the second side S2 may be greater than or equal to the number of steps on the first side S1. Accordingly, the radiator region 1110 also may be formed in an asymmetric structure and constitute an asymmetric CPW antenna.

In the plurality of step structures constituting the radiator region 1110, the current direction CR is a first direction along the other axis, i.e., the x axis. On the contrary, the current direction CG2 in the second ground region 1160 is a second direction along the other axis, i.e., the x axis. Meanwhile, the current direction CG1 in the first ground region 1150 is formed along the one axis.

Referring to FIG. 6, the antenna assembly may include a dielectric substrate 1010, a radiator region 1110*a*, a first ground region 1150, and a second ground region 1160.

The first ground region 1150 may be disposed on one side of the feed line 1120 disposed on the dielectric substrate 1010. In the radiator region 1110*a*, a first side S1*a* and a second side S2 corresponding to the opposite side of the first side S1*a* may form end portions of conductive patterns such that the conductive patterns having different widths are formed in a plurality of step structures. The first side S1*a* of the radiator region 1110*a* may be formed in a linear structure in the first region R1 which is an upper region and the second region R2 which is a lower region. The second ground region 1160 may be disposed on one side of the feed line 1120 disposed on the dielectric substrate 1010.

The dielectric substrate 1010 is configured such that the radiator region 1110*a*, the feed line 1120, the first ground region 1150, and the second ground region 1160 are disposed on a surface thereof. The dielectric substrate 1010 may be implemented as a substrate having a predetermined permittivity and thickness. When the antenna assembly is implemented as a transparent antenna, the dielectric substrate 1010 may be implemented as a transparent substrate made of a transparent material. As previously described with reference to FIG. 5, the radiator region 1110 may be implemented as conductive patterns on the dielectric substrate 1010 to radiate radio signals. When the antenna assembly is implemented as a transparent antenna, the conductive patterns may be configured as the metal mesh grid 1020*a* of FIG. 5. On the other hand, the dielectric region may be implemented as the dummy mesh grid 1020*b* of FIG. 5.

The feed line 1120 may be configured to apply a signal on the same plane as the conductive patterns of the radiator region 1110. Accordingly, since the radiator region 1110*a* and the feed line 1120 are disposed on the same plane, a CPW antenna structure can be implemented. In the broadband CPW antenna assembly of FIG. 6, the first side S1*a* of the radiator region 1110 in the first region R1 which is the upper region and the second region R2 which is the lower region is formed in a linear structure. Meanwhile, the second side S2 of the radiator region 1110*a* in the first region R1 which is the upper region and the second region R2 which is the lower region is formed in a plurality of step structures.

Meanwhile, the asymmetric CPW structure of FIG. 6 may be formed such that the lengths L1*a* and L2*a* of the first and second ground regions 1150 and 1160 are different, similarly to the asymmetric CPW structure of FIG. 5. Specifically, the first ground region 1150 may be made longer than the second ground region 1160 in one axial direction. The length L1*a* of the first ground region 1150 is greater than the length L2*a* of the second ground region 1160 in one axial direction, that is, the y-axis direction, along which the first region R1 and the second region R2 are separated. Accordingly, an asymmetric CPW structure is formed. On the other hand, the width W1*a* of the first ground region 1150 may be smaller than the width W2*a* of the second ground region 1160.

The number of steps on the second side S2 may be greater than or equal to the number of steps on the first side S1*a*. Accordingly, the radiator region 1110*a* also may be formed in an asymmetric structure and constitute an asymmetric CPW antenna. Moreover, it may be construed that the first side S1*a* of the radiator region 1110*a* is formed in a linear structure, and the second side S2 is formed in a plurality of step structures, thereby constituting an asymmetric CPW antenna.

Referring to FIGS. 5 and 6, in the broadband CPW antenna assembly, at least one side may be formed in a linear structure. In relation to this, the first side S1 and S1*a* in the radiator region 1110 and 1110*a* adjacent to the first ground region 1150 in one axial direction may be formed in a linear structure.

Referring to FIG. 5, the first side S1 of the radiator region 1110 may be formed in M step structures in an upper part of the first ground region 1150. The second side S2 of the radiator region 1110 disposed over the second ground region 1160 may be formed in N step structures, where N is a number greater than M. Meanwhile, referring to FIG. 6, the first side S1*a* of the radiator region 1110 may be formed in a linear structure. The second side S2 of the radiator region 1110 disposed over the second ground region 1160 may be formed in Nb step structures. Accordingly, the first and second ground regions 1150 and 1160 formed in a linear structure may have an asymmetric structure. Thus, the first ground region 1150 may be made longer than the second ground region 1160 in one axial direction, i.e., the y-axis direction.

Referring to FIGS. 5 and 6, the first ground region 1150 may be smaller in width than the second ground region 1160 in the other axial direction, i.e., the x-axis direction, which may reduce the width of the antenna assembly. Referring to FIG. 5, the width W1 of the first ground region 1150 may be smaller than the width W2 of the second ground region 1160, which may reduce the width of the antenna assembly. Referring to FIG. 6, the width W1*a* of the first ground region 1150 may be smaller than the width W2*a* of the second ground region 1160, which may reduce the width of the antenna assembly.

As illustrated in FIG. 5, a current CR in the radiator region 1110 and a current CG2 in the second ground region 1160 may be formed in a direction opposite to one axial direction, i.e., the x-axis direction. Referring to FIGS. 5 and 6, the CPW antenna assembly may be configured to operate over a wide band by an interaction between the current CR in the radiator region 1110 and 1110*a* and the current CG2 in the second ground region 1160.

To this end, the overall width of the ground region including the first ground region 1150 and the second ground region 1160 is greater than the overall width of the radiator region 1110 and 1110*a*. Thus, end portions on the first side S1 and S1*a* of the radiator region 1110 and 1110*a* formed over the first ground region 1150 may be formed between opposite ends of the first ground region 1150. Also, end portions on the second side S2 of the radiator region 1110 and 1110*a* formed over the second ground region 1160 may be formed between opposite ends of the first ground region 1160.

Figure 7A:
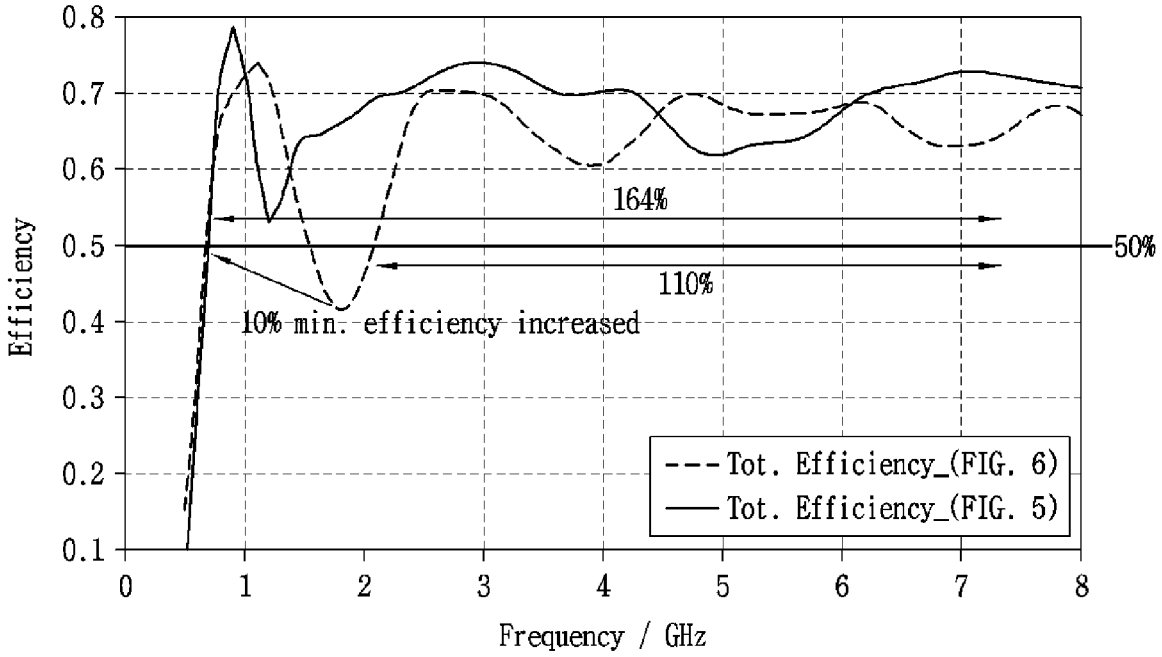
FIG. 7A shows a comparison of efficiency characteristics of the broadband CPW antenna assemblies of FIGS. 5 and 6.
Figure 7B:
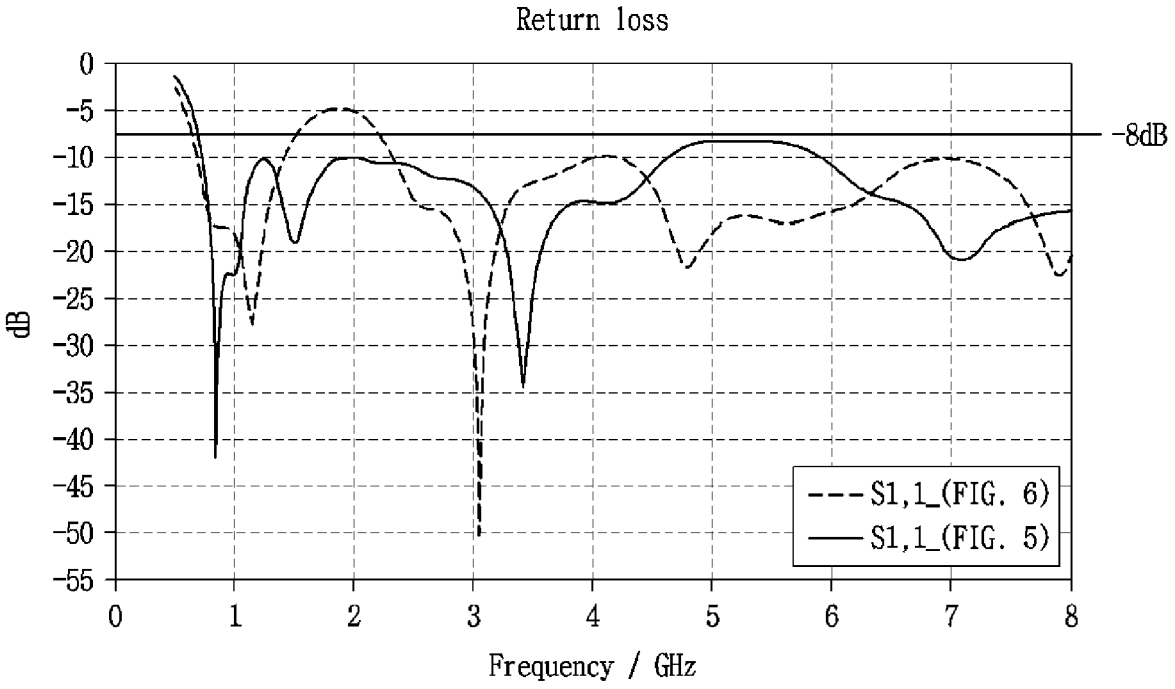
FIG. 7B shows a comparison of reflection loss characteristics of the broadband CPW antenna assemblies of FIGS. 5 and 6.

The antenna performance of the broadband CPW antenna assemblies of FIGS. 5 and 6 will be described below. FIG. 7A shows a comparison of efficiency characteristics of the broadband CPW antenna assemblies of FIGS. 5 and 6. Meanwhile, FIG. 7B shows a comparison of reflection loss characteristics of the broadband CPW antenna assemblies of FIGS. 5 and 6.

Referring to FIG. 7A, the antenna structure of FIG. 5 has a bandwidth of about 164% with respect to a 50% efficiency bandwidth. Meanwhile, the antenna structure of FIG. 6 has a bandwidth of about 110% with respect to a 50% efficiency bandwidth. Thus, the antenna structure of FIG. 5 in which both sides of the radiator region are formed in step structures is advantageous in terms of antenna efficiency bandwidth. Also, the antenna structure of FIG. 5 in which both sides of the radiator region are formed in step structures is advantageous in terms of overall antenna size. On the other hand, the antenna structure of FIG. 6 in which one side of the radiator region are formed in step structures may be configured by simplifying the radiator region. Referring to FIG. 7B, the antenna structures of FIGS. 5 and 6 have reflection loss characteristics of −8 dB or lower across the entire range.

Meanwhile, the antenna structure of FIG. 5 in which the first and second sides S1 and S2 of the radiator region 1110 are formed in step structures has an asymmetric radiator structure with respect to the feed line 1120. Thus, the formation of the first and second sides S1 and S2 in step structures may increase resonance points, thereby allowing for designing a structure capable of maintaining or improving bandwidth characteristics while reducing antenna size.

The antenna structure of FIG. 5 may be designed with an antenna size of 78×129 mm and correspond to a wavelength of 0.18×0.3. Accordingly, the antenna structure of FIG. 5 allows for both broadband operation and antenna miniaturization. The antenna structure of FIG. 6 may be designed with an antenna size of 111×127 mm and correspond to a wavelength of 0.25×0.27. Accordingly, the antenna structure of FIG. 6 also allows for both broadband operation and antenna miniaturization.

The antenna structure of FIG. 5 in which both sides of the radiator region are formed in step structure may have a 26% smaller antenna area than the antenna structure of FIG. 6 in which one side of the radiator region is formed in step structures. Meanwhile, the antenna structure of FIG. 5 may have a 54% higher antenna efficiency bandwidth than the antenna structure of FIG. 5. Moreover, the antenna structure of FIG. 5 may have a 10% increase in minimum efficiency within the antenna band, from 42% to 52%, compared to the antenna structure of FIG. 6.

Figure 8A:
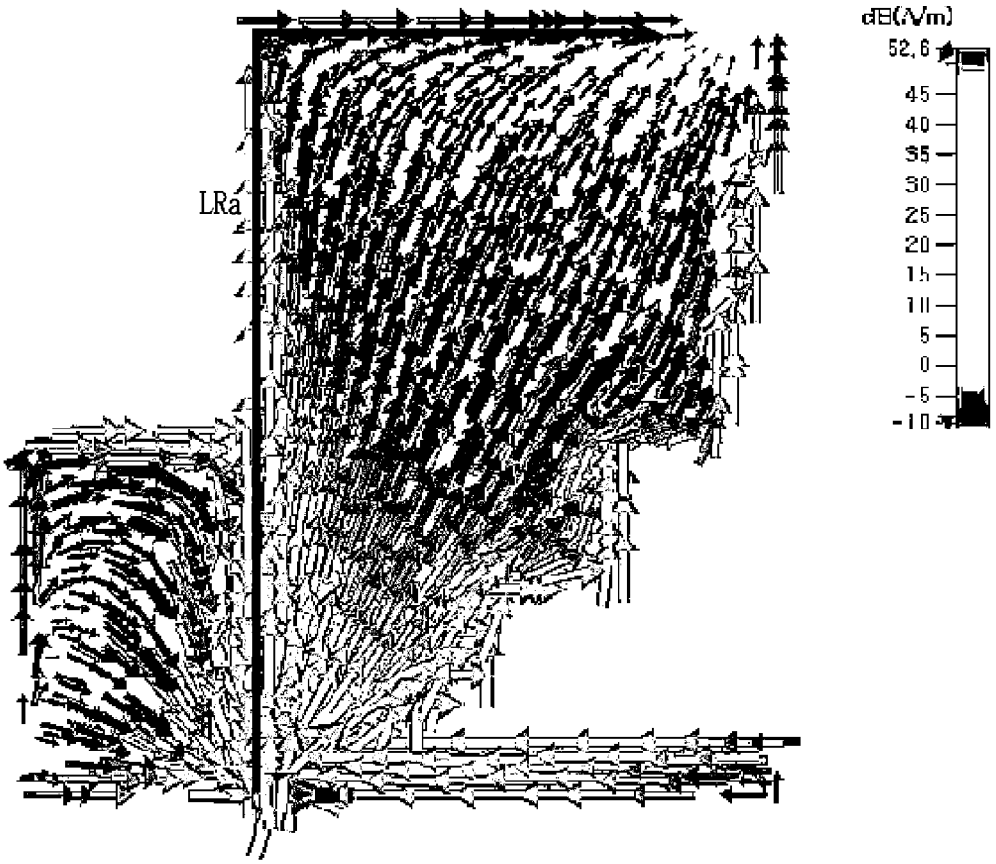
FIG. 8A depicts current distribution characteristics in the broadband CPW antenna assembly structure of FIG. 6.
Figure 8B:
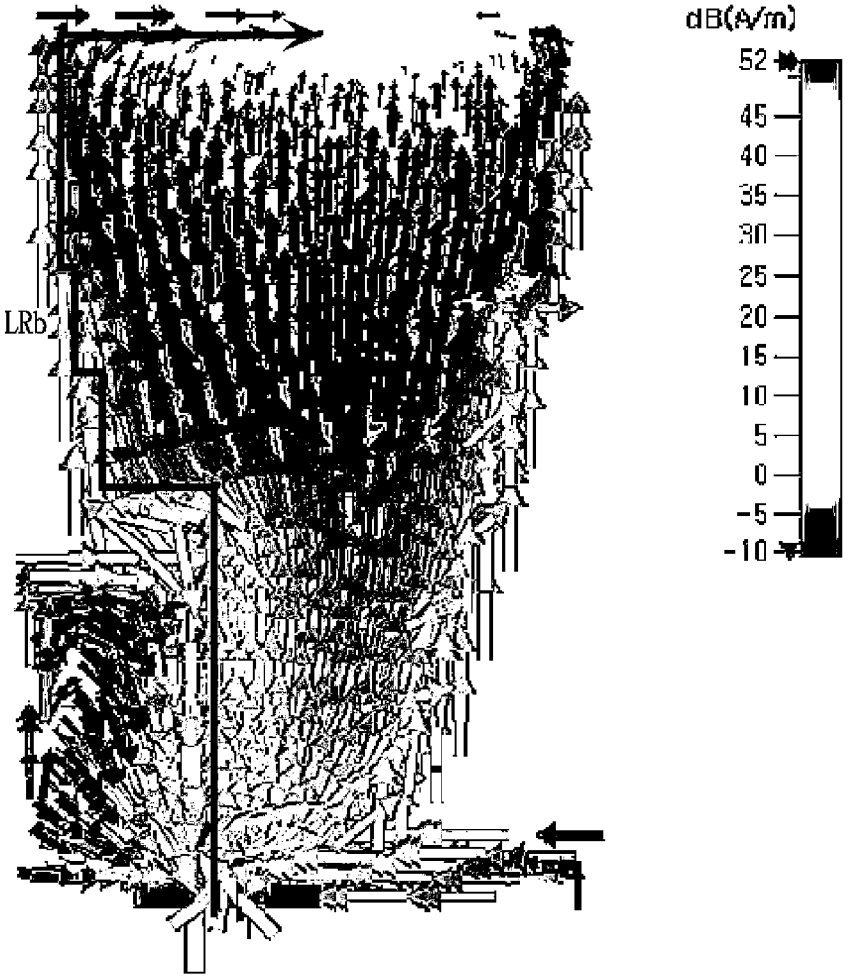
FIG. 8B depicts current distribution characteristics in the broadband CPW antenna assembly structure of FIG. 5.

FIG. 8A depicts current distribution characteristics in the broadband CPW antenna assembly structure of FIG. 6. FIG. 8B depicts current distribution characteristics in the broadband CPW antenna assembly structure of FIG. 5. The current distributions in FIGS. 8A and 8B depict current distributions at 700 MHz which corresponds to a low band LB, but are not limited to that frequency.

Referring to FIGS. 6 and 8A, a current path on the first side Sla formed in a linear structure is formed as a linear path, and its electrical length is denoted by LRa. Referring to FIGS. 5 and 8B, a current path on the first side S1 formed in step structures is formed as a path with step structures, and its electrical length is denoted by LRb. In relation to this, the electrical length LRa of the current path in FIG. 8A and the electrical length LRb of the current path in FIG. 8B may be set equal. If they have the same electrical length, the antenna structure of FIG. 6 may be implemented to have a smaller size.

The antenna structure of FIG. 6 may reduce the overall antenna size in a low frequency range by using an asymmetric radiator and generate a surface current equal or similar in length to the antenna structure of FIG. 5. Thus, the antenna structure of FIG. 6 may reduce antenna width while maintaining radiation efficiency.

Figure 9:
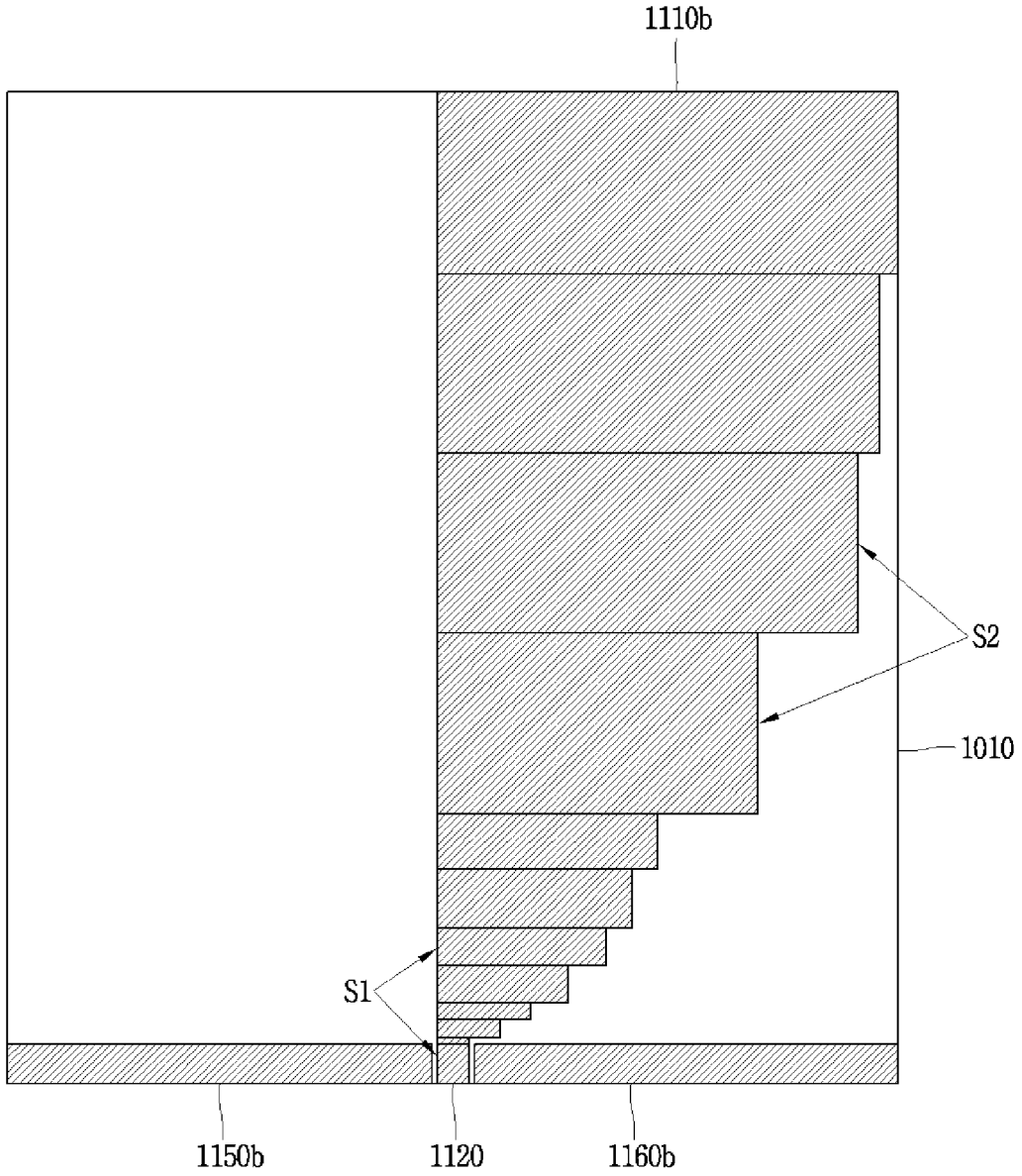
FIG. 9 depicts a broadband CPW antenna assembly with a feeding portion having a symmetric structure according to an embodiment of the present disclosure.

Meanwhile, a broadband CPW antenna assembly according to the present disclosure may have various structures depending on applications. For example, as a radiator of the broadband CPW antenna assembly is formed in an asymmetric structure, a feeding portion may be formed in a symmetric structure. FIG. 9 depicts a broadband CPW antenna assembly with a feeding portion having a symmetric structure according to an embodiment of the present disclosure. In relation to this, in a transparent antenna implemented on transparent glass such as glass for a vehicle, only some part of the feeding portion may be implemented in a transparent region of glass. In relation to this, most of the feeding portion may be implemented in a semi-transparent region of glass or on a separate semi-transparent or opaque substrate. Thus, even if the overall width of the antenna assembly is increased to some extent by a symmetric feeding structure as in FIG. 9, the width of the radiator region having an asymmetric structure may be substantially reduced.

Referring to FIG. 9, the antenna assembly may include a dielectric substrate 1010, a radiator region 1110*b*, a first ground region 1150*b*, and a second ground region 1160*b*.

The first ground region 1150*b* may be disposed on one side of the feed line 1120 disposed on the dielectric substrate 1010. In the radiator region 1110*a*, a first side S1*b* and a second side S2 corresponding to the opposite side of the first side S1*b* may form end portions of conductive patterns such that the conductive patterns having different widths are formed in a plurality of step structures. The first side S1*b* of the radiator region 1110*a* may be formed in a linear structure in the first region R1 which is an upper region and the second region R2 which is a lower region. The second ground region 1160*b* may be disposed on the other side of the feed line 1120 disposed on the dielectric substrate 1010. The first ground region 1150*b* and the second ground region 1160*b* may be substantially equal in length and width.

The dielectric substrate 1010 is configured such that the radiator region 1110*a*, the feed line 1120, the first ground region 1150*b*, and the second ground region 1160*b* are disposed on a surface thereof. The dielectric substrate 1010 may be implemented as a substrate having a predetermined permittivity and thickness. When the antenna assembly is implemented as a transparent antenna, the dielectric substrate 1010 may be implemented as a transparent substrate made of a transparent material. As previously described with reference to FIG. 5, the radiator region 1110*b* may be implemented as conductive patterns on the dielectric substrate 1010 to radiate radio signals. When the antenna assembly is implemented as a transparent antenna, the conductive patterns may be configured as the metal mesh grid 1020*a* of FIG. 5. On the other hand, the dielectric region may be implemented as the dummy mesh grid 1020*b* of FIG. 5.

The feed line 1120 may be configured to apply a signal on the same plane as the conductive patterns of the radiator region 1110*b*. Accordingly, the radiator region 1110*b* and the feed line 1120 are disposed on the same plane, thereby implementing a CPW antenna structure.

Referring to FIGS. 6 and 9, in the broadband CPW antenna assembly, the first side S1*a* and S1*b* of the radiator region 1110*a* and 1110*b* in the first region R1 which is the upper region and the second region R2 which is the lower region is formed in a linear structure. On the other hand, the second side S2 of the radiator region 1110*a* and 1110*b* in the first region R1 which is the upper region and the second region R2 which is the lower region is formed in a plurality of step structures.

Referring to FIGS. 6 and 9, the number of steps on the second side S2 may be greater than or equal to the number of steps on the first side S1*a* and S1*b*. Accordingly, the radiator region 1110*a* also may be formed in an asymmetric structure and constitute an asymmetric CPW antenna. Moreover, it may be construed that the first side S1*a* and S1*b* of the radiator region 1110*a* is formed in a linear structure, and the second side S2 is formed in a plurality of step structures, thereby constituting an asymmetric CPW antenna.

Referring to FIGS. 6 and 9, the radiator region 1110*a* and 1110*b* may be disposed only in an upper region of either the first ground region 1150 and 1150*b* or the second ground region 1160 and 1160*b*. For example, the radiator region 1110*a* and 1110*b* may be disposed only in an upper region of the second ground region 1160 and 1160*b*. Meanwhile, the first side S1*a* and S1*b* of the radiator region 1110*a* and 1110*b* may be formed in a linear structure. The second side of the radiator region 1110*a* and 1110*b* may form a plurality of step structures by the conductive patterns having different widths.

Referring to FIGS. 5, 6, and 9, the conductive patterns of the radiator region 1110, 1110*a*, and 1110*b* may be disposed asymmetrically in the other axial direction with respect to an extension line of the feed line 1120 formed in the one axial direction, which may reduce the width of the antenna assembly. Specifically, the radiator region 1110, 1110*a*, and 1110*b* may be disposed only on one side with respect to the center line of the feed line 1120 or disposed asymmetrically with respect to the center line.

Figure 10A:
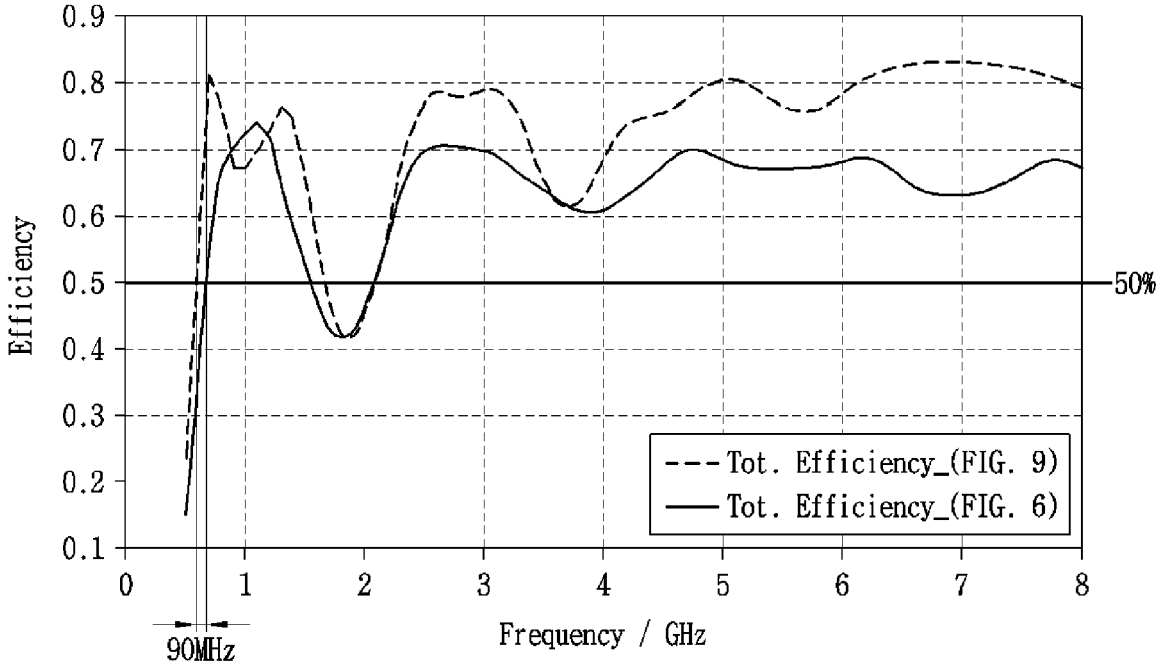
FIG. 10A shows a comparison of efficiency characteristics of the broadband CPW antenna assemblies of FIGS. 6 and 9.
Figure 10B:
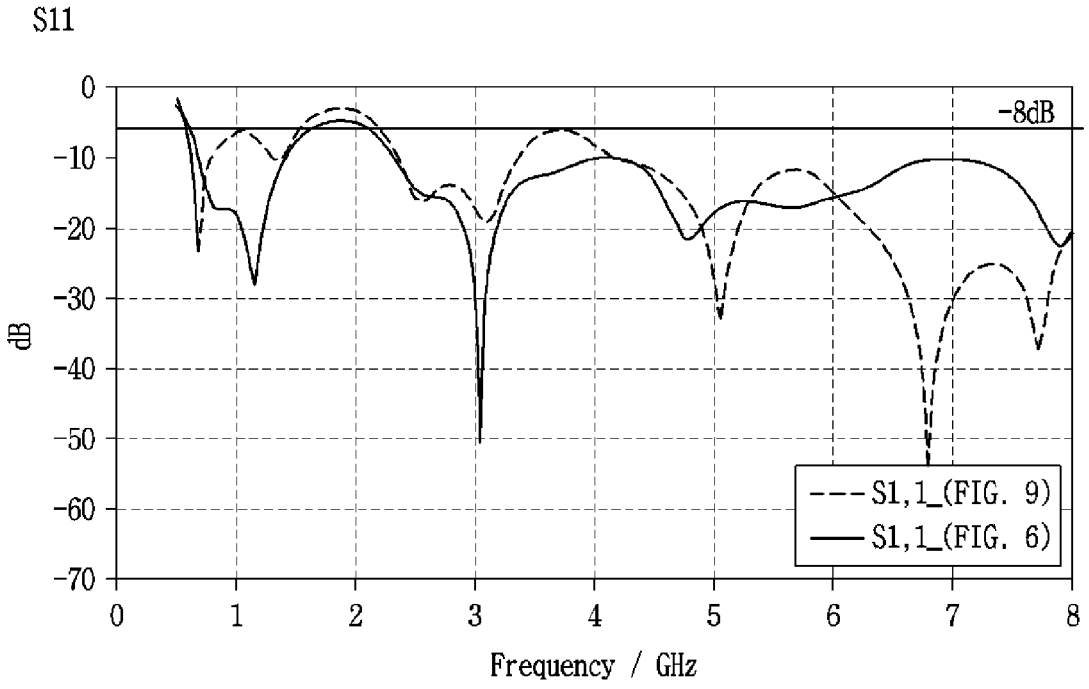
FIG. 10B shows a comparison of reflection loss characteristics of the broadband CPW antenna assemblies of FIGS. 6 and 9.

The antenna performance of the broadband CPW antenna assemblies of FIGS. 6 and 9 will be described below. FIG. 10A shows a comparison of efficiency characteristics of the broadband CPW antenna assemblies of FIGS. 6 and 9. Meanwhile, FIG. 10B shows a comparison of reflection loss characteristics of the broadband CPW antenna assemblies of FIGS. 6 and 9.

Referring to FIG. 10A, the antenna structures of FIGS. 6 and 9 have similar characteristics with respect to a 50% efficiency bandwidth. Thus, even if the length of the first ground region 1150 of FIG. 6 becomes smaller than the length of the first ground region 1150*b* of FIG. 9, it has no significant effect on antenna efficiency bandwidth. As previously described, the antenna structure of FIG. 6 has a bandwidth of about 110% with respect to the 50% efficiency bandwidth. Referring to FIG. 10B, the antenna structures of FIGS. 6 and 9 have reflection loss characteristics of −8 dB or lower across the entire range.

Meanwhile, as shown in FIGS. 6 and 9, an antenna structure in which the second side S2 of the radiator region 1110*a* and 1110*b* is formed in step structures is configured in an asymmetric radiator structure with respect to the feed line 1120. In relation to this, the first side S1 of the radiator region 1110*a* and 1110*b* is formed in a linear structure, and therefore the antenna structure is configured in an asymmetric radiator structure with respect to the feed line 1120.

The antenna structure of FIG. 6 may be designed with an antenna size of 111×127 mm and correspond to a wavelength of 0.25×0.27. Accordingly, the antenna structure of FIG. 6 allows for both broadband operation and antenna miniaturization. The antenna structure of FIG. 9 may be designed with an antenna size of 148×123 mm and correspond to a wavelength of 0.29×0.27. Accordingly, the antenna structure of FIG. 9 also allows for both broadband operation and antenna miniaturization.

The antenna structure of FIG. 6 in which the width of the first ground region 1150 is reduced may have a 25% smaller antenna area than the antenna structure of FIG. 9 in which the first and second ground regions 1150*b* and 1160*b* have a symmetric CPW structure. Referring to FIGS. 9 and 10A, the antenna operates from 580 MHz if it has an antenna size of 148×123 mm. On the other hand, referring to FIGS. 6 and 10A, the antenna operates from 670 MHz if it has an antenna size of 111×127 mm. Thus, the broadband CPW antenna assembly of FIG. 9 having an asymmetric CPW line may have a larger antenna size, but the antenna operating frequency may be expanded to a lower frequency.

Figure 11A:
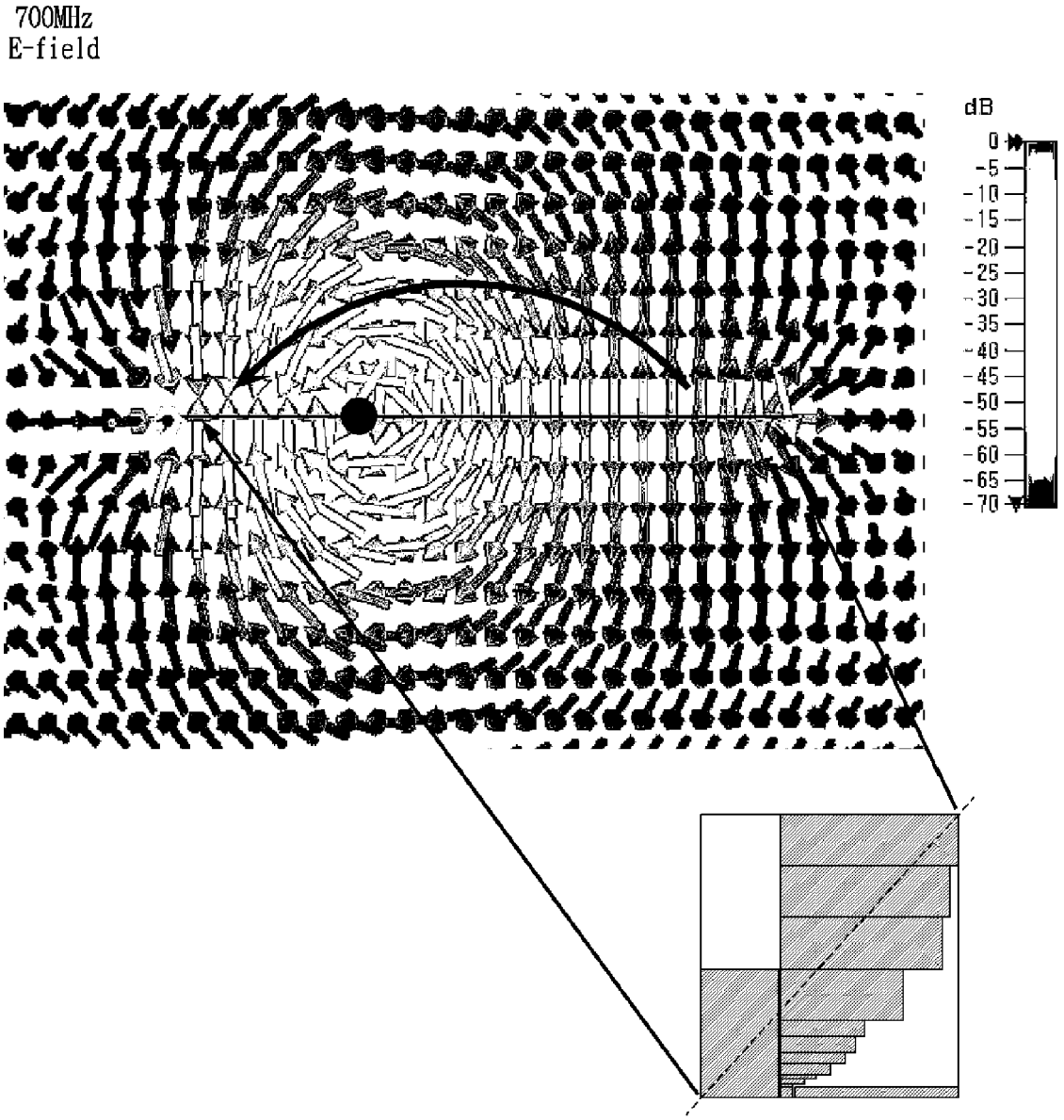
FIG. 11A depicts an electric field distribution in the CPW antenna structure of FIG. 6.
Figure 11B:
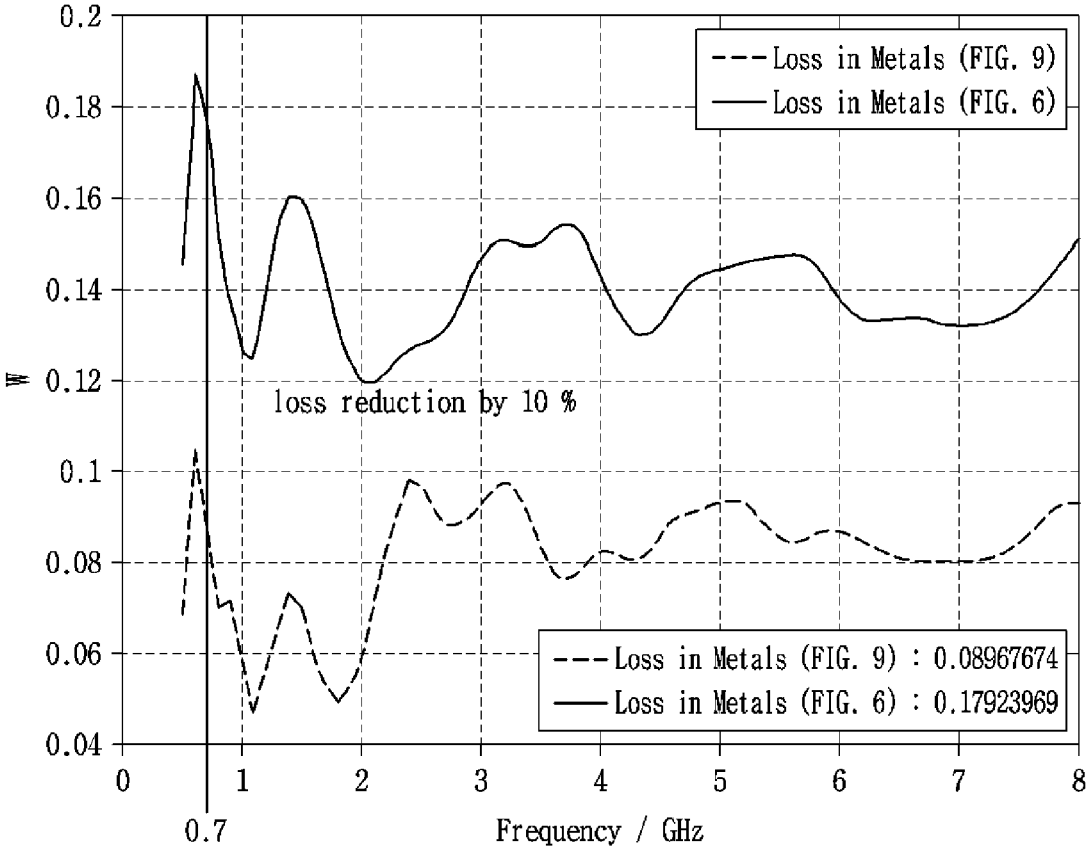
FIG. 11B shows a comparison of antenna loss when the CPW antenna structures of FIGS. 6 and 9 are implemented as a transparent antenna.

Meanwhile, the characteristics of a broadband CPW antenna in which one side of the radiator region is formed in a linear structure as in FIGS. 6 and 9 will be described below in details. In relation to this, FIG. 11A depicts an electric field distribution in the CPW antenna structure of FIG. 6. In relation to this, the electric field distribution in the CPW antenna structure is shown at 700 MHz, but is not limited thereto. FIG. 11B shows a comparison of antenna loss when the CPW antenna structures of FIGS. 6 and 9 are implemented as a transparent antenna.

Referring to the electric field distribution of FIG. 11A in relation to the CPW antenna structure of FIG. 6, it can be found out that a radio signal is radiated through an asymmetrically-shaped ground region. Thus, the radiation of radio signals is partially done through the first ground region 1110 having an asymmetric shape, which increases the antenna efficiency of the CPW antenna structure of FIG. 6 compared to the antenna efficiency of the CPW antenna structure of FIG. 9 having a symmetric feeding structure.

Referring to FIG. 11B, the antenna loss in the antenna structure of FIG. 6 is about 10% lower than the antenna loss in the CPW antenna structure of FIG. 9 having a symmetric feeding structure. In the antenna structure of FIG. 6, a radio signal is additionally radiated through the first ground region 1110 having an asymmetric shape. Such additional radiation decreases the amount of current loss in the current applied to the antenna, which may reduce the loss in the metal mesh which is a transparent material by about 10%.

Therefore, the CPW antenna structure of FIG. 6 having an asymmetric feeding structure has advantages over the CPW antenna structure of FIG. 9 having a symmetric feeding structure, in terms of antenna efficiency and overall antenna size. Meanwhile, the operating frequency range of the CPW antenna structure of FIG. 9 having a symmetric feeding structure may be expanded to a lower frequency.

Figure 12A:
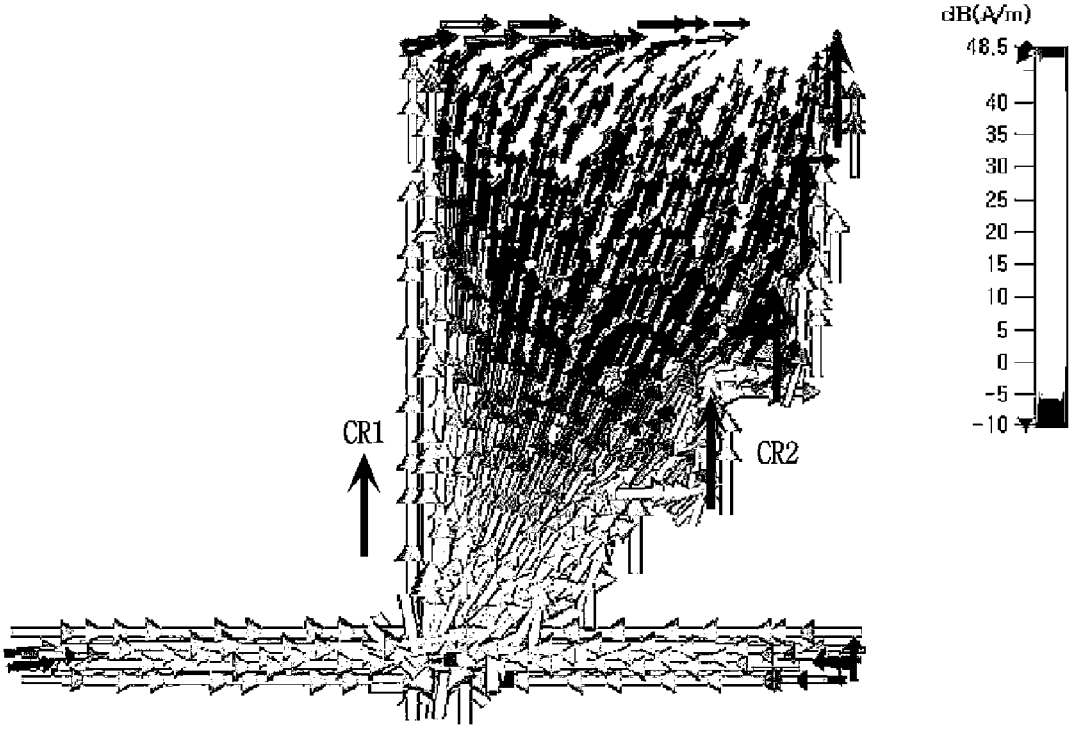
FIG. 12A depicts current distribution characteristics in the broadband CPW antenna assembly structure of FIG. 9.
Figure 12B:
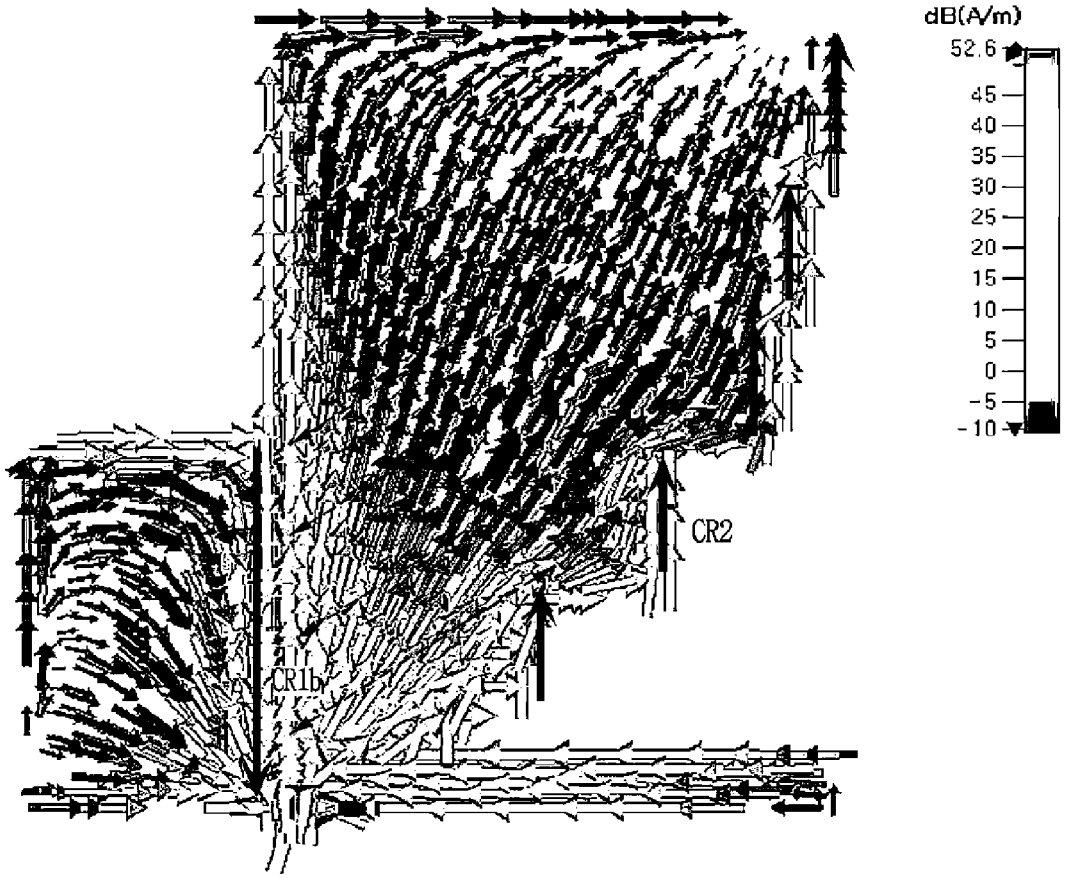
FIG. 12B depicts current distribution characteristics in the broadband CPW antenna assembly of FIG. 6.

FIG. 12A depicts current distribution characteristics in the broadband CPW antenna assembly structure of FIG. 9. FIG. 12B depicts current distribution characteristics in the broadband CPW antenna assembly of FIG. 6. The current distributions in FIGS. 12A and 12B depict current distributions at 700 MHz corresponding to a low band LB, but are not limited to that frequency.

Referring to FIGS. 9 and 12A, there are surface currents CR1 and CR2 moving up in the radiator region 1110*b*, but there are no parallel surface current vector components of the opposite phase. Accordingly, anything other than the radiator region 1110*b* of the antenna makes no contribution to the additional radiation. On the other hand, referring to FIGS. 6 and 12B, a surface current CR1*b* of the opposite phase moving down is generated by the first ground region 1150 having an asymmetric shape. Accordingly, a radio signal may be additionally radiated through the first ground region 1150 having an asymmetric shape, apart from the radiator region 1110*a* of the antenna, by the surface current CR1*b* of the opposite phase.

Figure 13:
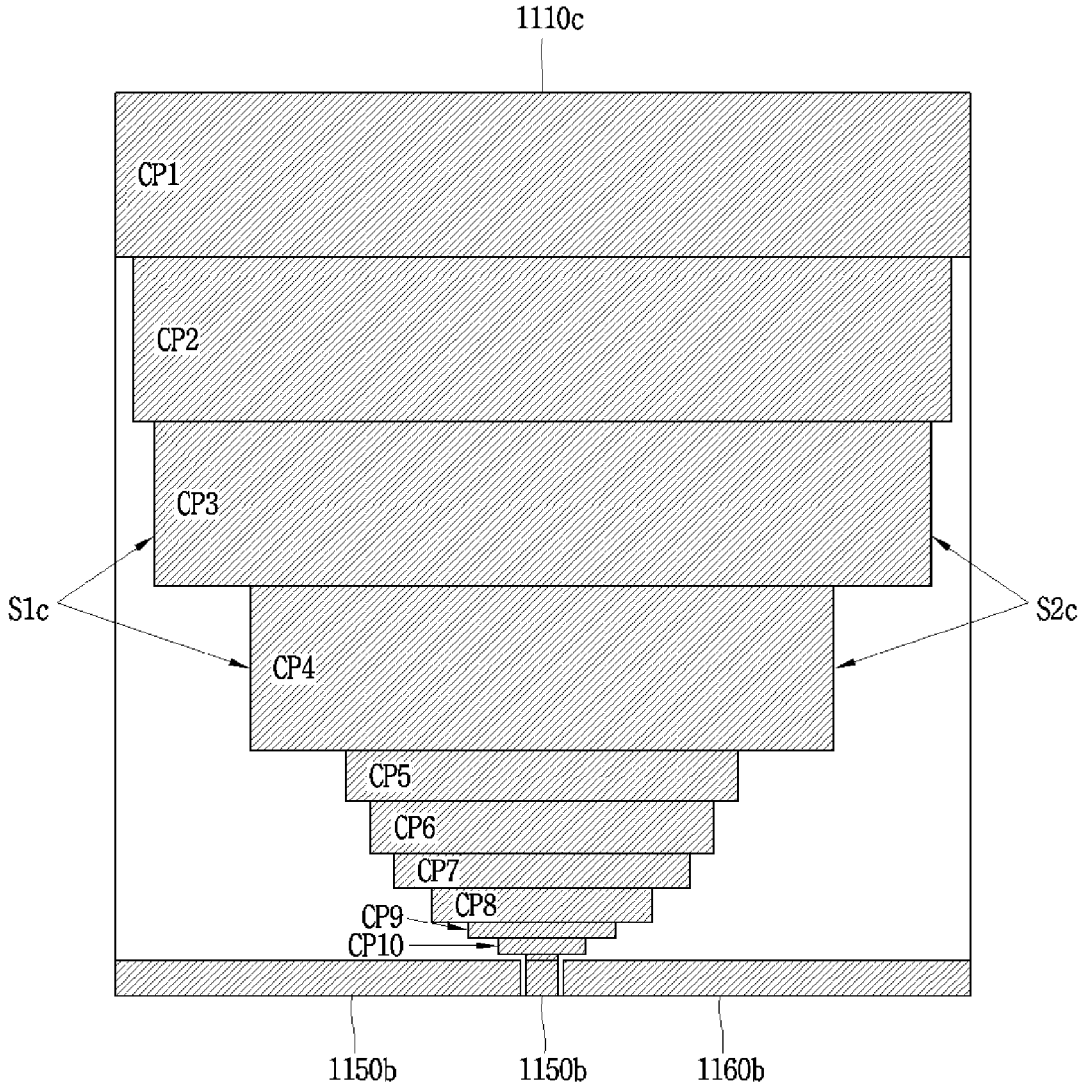
FIG. 13 depicts a broadband CPW antenna assembly with a feeding portion and a radiator region that have a symmetric structure according to an embodiment of the present disclosure.

Meanwhile, a broadband CPW antenna assembly according to the present disclosure may have various structures depending on applications. In relation to this, both the feeding portion and radiator region of the broadband CPW antenna assembly may have a symmetric structure. FIG. 13 depicts a broadband CPW antenna assembly with a feeding portion and a radiator region that have a symmetric structure according to an embodiment of the present disclosure. In relation to this, in a transparent antenna implemented on transparent glass such as glass for a vehicle, both the feeding portion and the radiator region may be formed in a symmetric structure unless there are antenna size limitations.

Referring to FIG. 13, the antenna assembly may include a dielectric substrate 1010, a radiator region 1110*c*, a first ground region 1150*b*, and a second ground region 1160*b*.

The first ground region 1150*b* may be disposed on one side of the feed line 1120 disposed on the dielectric substrate 1010. In the radiator region 1110*c*, a first side S1*c* and a second side S2*c* corresponding to the opposite side of the first side S1*c* may form end portions of conductive patterns such that the conductive patterns having different widths are formed in a plurality of step structures. On the first side S1*c* of the radiator region 1110*c*, the conductive patterns having different widths may be formed in a plurality of step structures in the entire regions. Likewise, on the second side S2*c* of the radiator region 1110*c*, the conductive patterns having different widths may be formed in a plurality of step structures in the entire regions. The radiator region 1110*c* may be configured to include a plurality of conductive patterns CP1, CP2, . . . , CP10. The number of the plurality of conductive patterns is not limited to the configuration illustrated in FIG. 13, but may vary depending on applications.

The radiator region 1110*c* may be formed in a symmetric region in which the distance to the first side S1*c* and the distance to the second side S2*c* are substantially equal with respect to the center line of the feed line 1120. The second ground region 1160*b* may be disposed on the other side of the feed line 1120 disposed on the dielectric substrate 1010. The first ground region 1150*b* and the second ground region 1160*b* may be substantially equal in length and width.

The dielectric substrate 1010 is configured such that the radiator region 1110*c*, the feed line 1120, the first ground region 1150*b*, and the second ground region 1160*b* are disposed on a surface thereof. The dielectric substrate 1010 may be implemented as a substrate having a predetermined permittivity and thickness. When the antenna assembly is implemented as a transparent antenna, the dielectric substrate 1010 may be implemented as a transparent substrate made of a transparent material. As previously described with reference to FIG. 5, the radiator region 1110*c* may be implemented as conductive patterns on the dielectric substrate 1010 to radiate radio signals. When the antenna assembly is implemented as a transparent antenna, the conductive patterns may be configured as the metal mesh grid 1020*a* of FIG. 5. On the other hand, the dielectric region may be implemented as the dummy mesh grid 1020*b* of FIG. 5.

The feed line 1120 may be configured to apply a signal on the same plane as the conductive patterns of the radiator region 1110*c*. Accordingly, the radiator region 1110*c* and the feed line 1120 are disposed on the same plane, thereby implementing a CPW antenna structure.

Figure 14A:
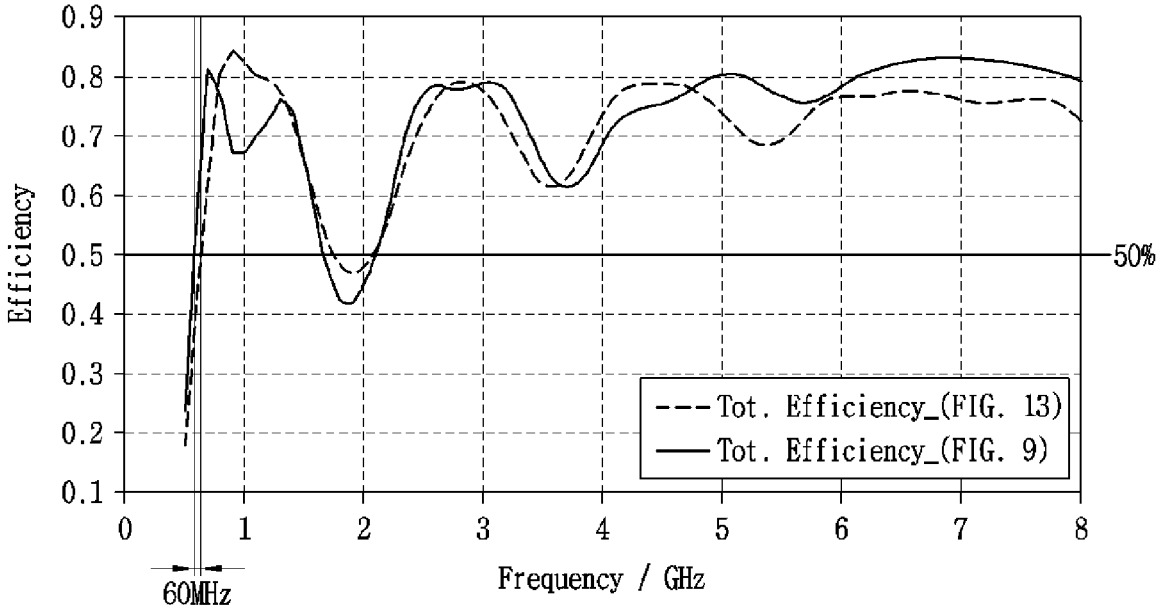
FIG. 14A shows a comparison of efficiency characteristics of the broadband CPW antenna assemblies of FIGS. 9 and 13.
Figure 14B:
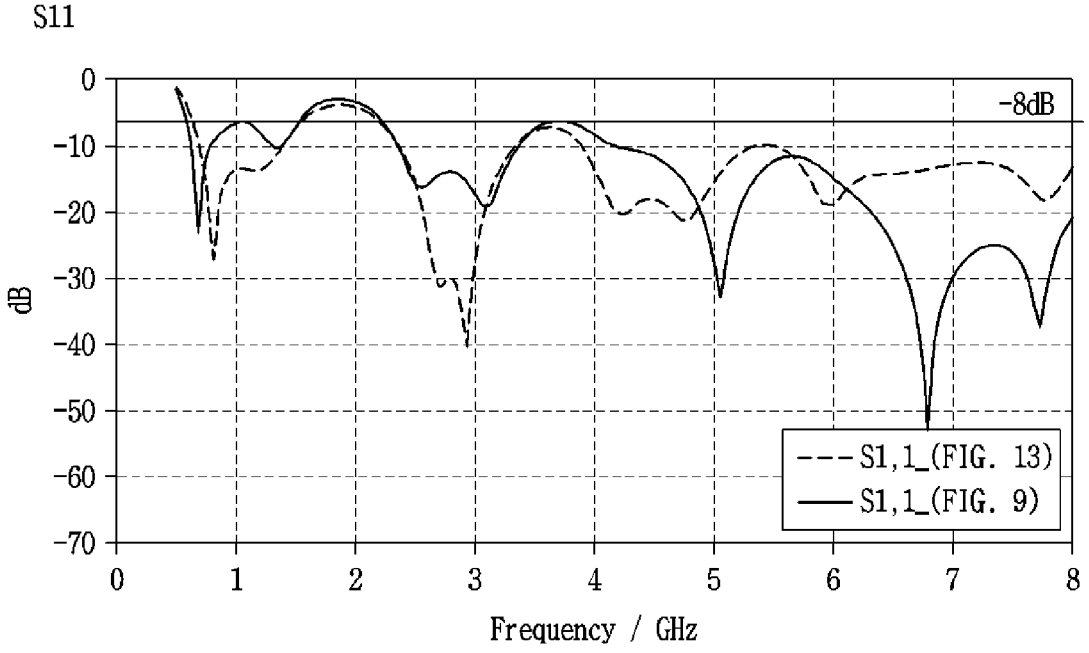
FIG. 14B shows a comparison of reflection loss characteristics of the broadband CPW antenna assemblies of FIGS. 9 and 13.

The antenna performance of the broadband CPW antenna assemblies of FIGS. 9 and 13 will be described below. FIG. 14A shows a comparison of efficiency characteristics of the broadband CPW antenna assemblies of FIGS. 9 and 13. Meanwhile, FIG. 14B shows a comparison of reflection loss characteristics of the broadband CPW antenna assemblies of FIGS. 9 and 13.

Referring to FIG. 14A, the antenna structures of FIGS. 9 and 13 have similar characteristics with respect to a 50% efficiency bandwidth. Thus, even if the radiator region 1110*b* is disposed only on one side of the feed line 1120 as in FIG. 9, it has no significant effect on antenna efficiency bandwidth. Referring to FIG. 14B, the antenna structures of FIGS. 9 and 13 have reflection loss characteristics of −8 dB or lower across the entire range.

Meanwhile, the antenna structure of FIG. 9 in which the radiator region 1110*b* formed only on one side may have advantages in terms of antenna miniaturization over the antenna structure of FIG. 13 in which the radiator region 1110*c* is formed in a symmetric structure. The radiator region 1110*b* of FIG. 9 having an asymmetric structure may be about half the radiator region 1110*c* of FIG. 13 having a symmetric structure, which is formed only on one side.

For example, the asymmetric antenna structure of FIG. 9 may reduce the antenna operating frequency as illustrated in FIG. 14D, while reducing the antenna size by about 9% compared to the symmetric antenna structure of FIG. 6. Referring to FIG. 14, the symmetric antenna structure of FIG. 13 operates from 640 MHz, whereas the asymmetric antenna structure of FIG. 9 operates with a frequency bandwidth that is lower by 60 MHz (9%).

Figure 15A:
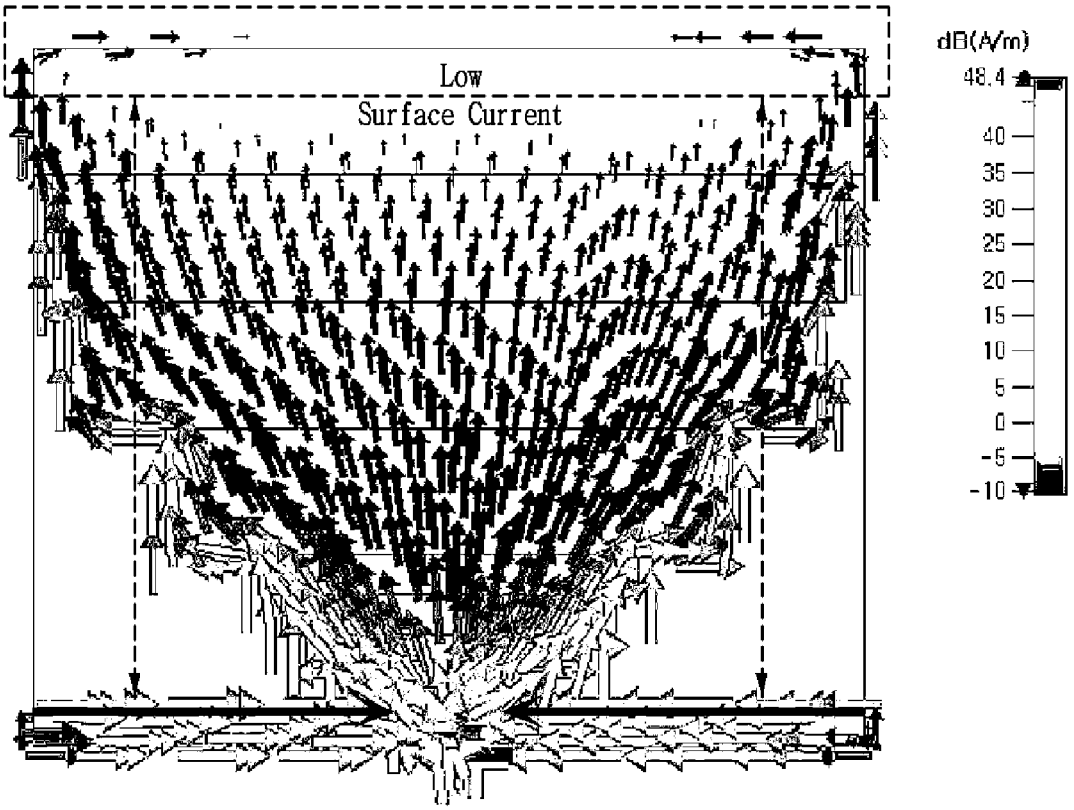
FIG. 15A depicts an electric field distribution in the CPW antenna structure of FIG. 13 in which the radiator region is formed in a symmetric structure.
Figure 15B:
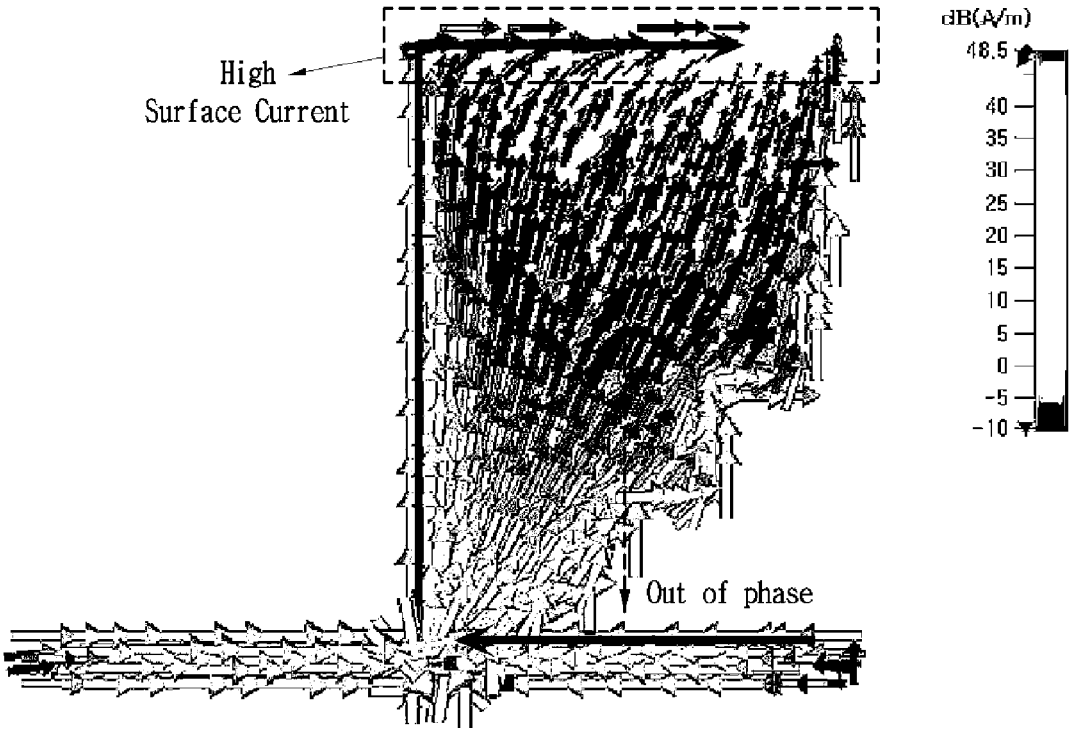
FIG. 15B depicts an electric field distribution in the CPW antenna structure of FIG. 9 in which the radiator region is formed only on one side.

FIG. 15A depicts an electric field distribution in the CPW antenna structure of FIG. 13 in which the radiator region is formed in a symmetric structure. Meanwhile, FIG. 15B depicts an electric field distribution in the CPW antenna structure of FIG. 9 in which the radiator region is formed only on one side. In relation to this, the electric field distribution in the CPW antenna structure is shown at 700 MHz, but is not limited thereto.

Referring to FIGS. 13 and 15A, a weak surface current is generated in an upper region of the radiator region 1110*c*. Due to the low surface current in the upper region, the radiation efficiency may be decreased in comparison with the size of the radiator region 1110*c*. Moreover, the current flow in the upper region of the radiator region 1110*c* and the current flow in the first and second ground regions 1150*b* and 1160*b* are in-phase. Because of such a current flow with an in-phase component, the radiation of radio signals is not done properly in the upper region of the radiator region 1110*c*.

Referring to FIGS. 9 and 15B, the radiator region 1110*b* formed only on one side of the feed line 1120 allows for generating a strong surface current that reaches as far as the upper region of the radiator region 1110*b*. Due to the high surface current in the upper region, the radiation efficiency may be increased in comparison with the size of the radiator region 1110*b*. Moreover, the current flow in the upper region of the radiator region 1110*b* and the current flow in the first and second ground regions 1150*b* and 1160*b* are out-of-phase. Because of such a current flow with an out-of-phase component, a radio signal is radiated properly in the upper region of the radiator region 1110*b*. Particularly, a current flow with an out-of-phase component in a low frequency band LB leads to an increase in radiation efficiency in the low frequency band.

Figure 16:
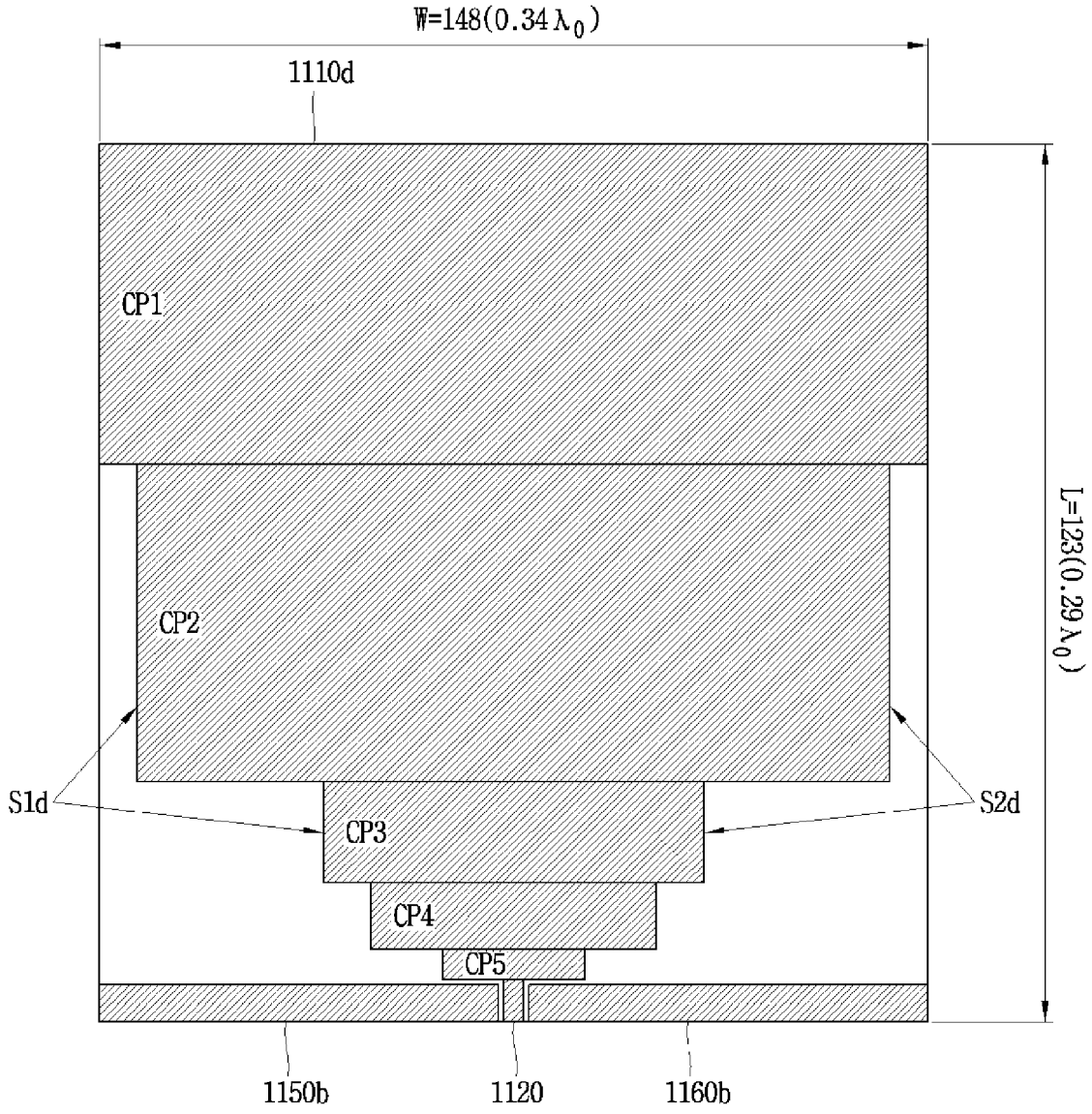
FIG. 16 depicts a broadband CPW antenna assembly with a radiator region having a symmetric structure whose number of steps is reduced.

Meanwhile, a broadband CPW antenna assembly according to the present disclosure may have various structures depending on applications. In relation to this, both the feeding portion and radiator region of the broadband CPW antenna assembly may have a symmetric structure, which may reduce the number of step structures and simplify the design of the antenna. FIG. 16 depicts a broadband CPW antenna assembly with a radiator region having a symmetric structure whose number of steps is reduced. In relation to this, in a transparent antenna implemented on transparent glass such as glass for a vehicle, both the feeding portion and the radiator region may be formed in a symmetric structure unless there are antenna size limitations.

Referring to FIG. 16, the antenna assembly may include a dielectric substrate 1010, a radiator region 1110*d*, a first ground region 1150*b*, and a second ground region 1160*b*. A detailed description of the configuration of FIG. 16 will be replaced with the description of FIG. 13, focusing on differences with FIG. 13.

The first ground region 1150*b* may be disposed on one side of the feed line 1120 disposed on the dielectric substrate 1010. In the radiator region 1110*d*, a first side S1*d* and a second side S2*d* corresponding to the opposite side of the first side S1*d* may form end portions of conductive patterns such that the conductive patterns having different widths are formed in a plurality of step structures. On the first side S1*d* of the radiator region 1110*d*, the conductive patterns having different widths may be formed in a plurality of step structures in the entire regions. Likewise, on the second side S2*d* of the radiator region 1110*d*, the conductive patterns having different widths may be formed in a plurality of step structures in the entire regions. The radiator region 1110*d* may be configured to include a plurality of conductive patterns CP1, CP2, . . . , CP5. The number of the plurality of conductive patterns is not limited to the configuration illustrated in FIG. 16, but may vary depending on applications.

The radiator region 1110*c* may be formed in a symmetric region in which the distance to the first side S1*d* and the distance to the second side S2*d* are substantially equal with respect to the center line of the feed line 1120. The second ground region 1160*b* may be disposed on the other side of the feed line 1120 disposed on the dielectric substrate 1010. The first ground region 1150*b* and the second ground region 1160*b* may be substantially equal in length and width. The feed line 1120 may be configured to apply a signal on the same plane as the conductive patterns of the radiator region 1110*d*. Accordingly, the radiator region 1110*d* and the feed line 1120 are disposed on the same plane, thereby implementing a CPW antenna structure.

Figure 17A:
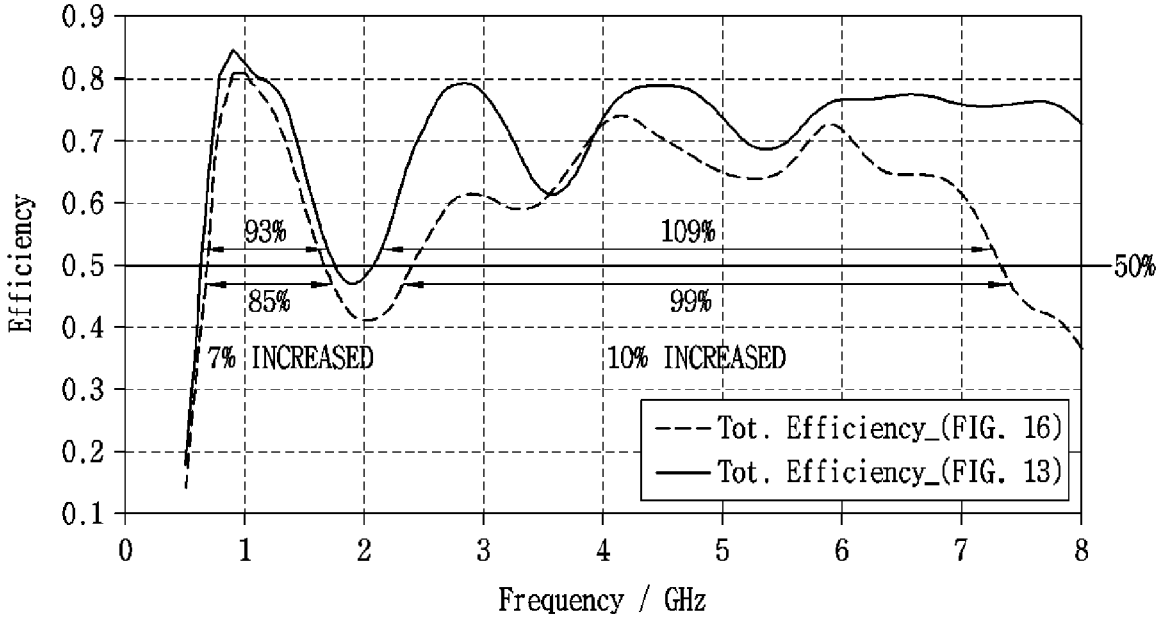
FIG. 17A shows a comparison of efficiency characteristics of the broadband CPW antenna assemblies of FIGS. 13 and 16.
Figure 17B:
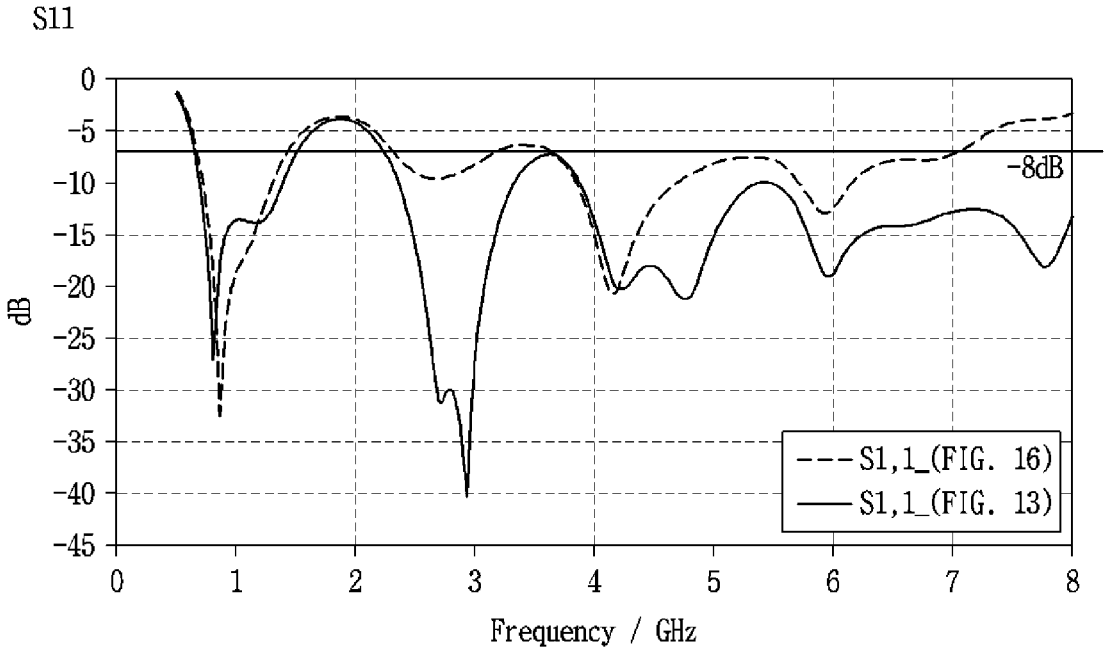
FIG. 17B shows a comparison of reflection loss characteristics of the broadband CPW antenna assemblies of FIGS. 13 and 16.

The antenna performance of the broadband CPW antenna assemblies of FIGS. 13 and 16 will be described below. FIG. 17A shows a comparison of efficiency characteristics of the broadband CPW antenna assemblies of FIGS. 13 and 16. Meanwhile, FIG. 17B shows a comparison of reflection loss characteristics of the broadband CPW antenna assemblies of FIGS. 13 and 16.

Referring to FIG. 17A, the antenna structures of FIGS. 13 and 16 have similar characteristics with respect to a 50% efficiency bandwidth. Thus, even if the number of steps in the radiator region 1110*d* is reduced as shown in FIG. 16, it has no significant effect on antenna efficiency bandwidth as long as that number is a certain value or higher. Referring to FIG. 17B, the antenna structures of FIGS. 13 and 16 have reflection loss characteristics of −8 dB or lower across the entire range. However, the impedance matching characteristics of the antenna structure of FIG. 16 may be degraded compared to the impedance matching characteristics of FIG. 13 due to the reduced number of steps.

Therefore, as shown in FIG. 13, the antenna may be designed to have multiple resonance points according to the increased number of steps, i.e., more conductive patterns, compared to FIG. 16. Referring to FIGS. 13 and 17A, it can be found out that the starting point of an antenna operating frequency moved from 670 MHz to 640 MHz, which is a 30 MHz shift to a lower frequency. Accordingly, the increased number of step structures in FIG. 13 makes the overall antenna size about 4% smaller than the reduced number of step structures in FIG. 16 does. Referring to FIG. 17A, the increased number of step structures in FIG. 13 allows for a 7% increase in bandwidth in a low frequency range and a 10% increase in bandwidth in a high frequency range, as compared to the structure of FIG. 16.

Figure 18A:
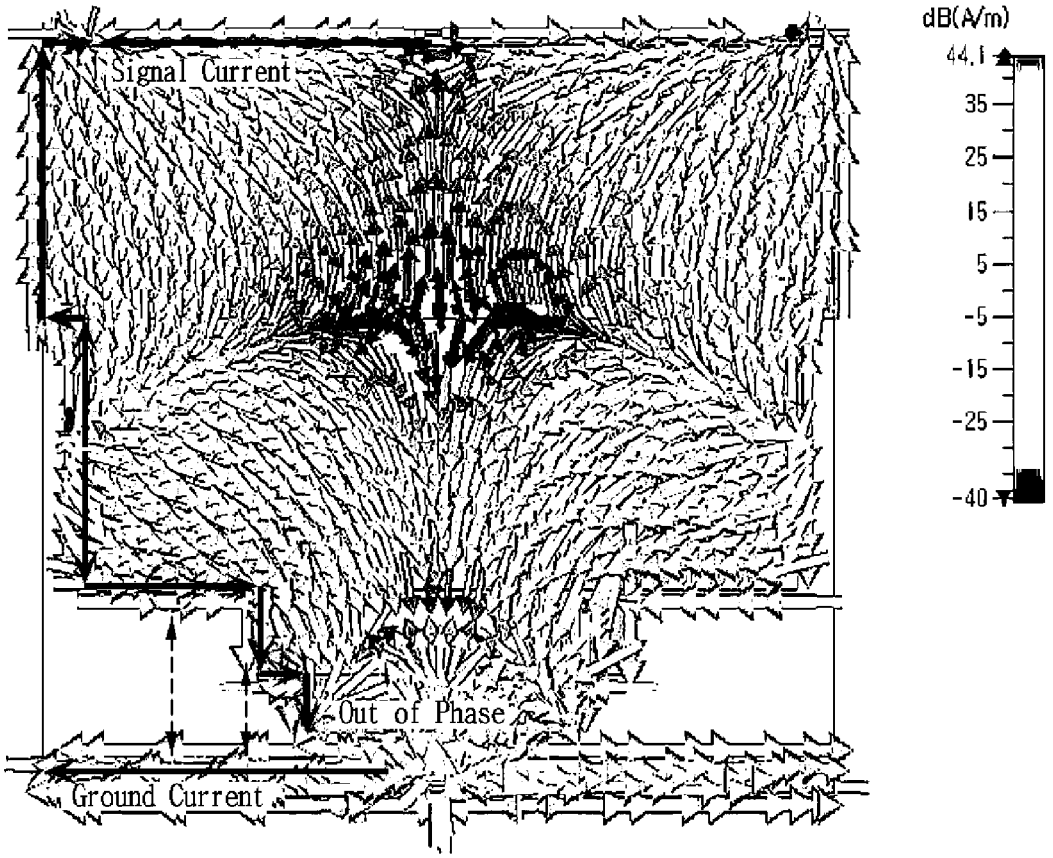
FIG. 18A depicts an electric field distribution in the CPW antenna structure of FIG. 16 having a reduced number of steps.
Figure 18B:
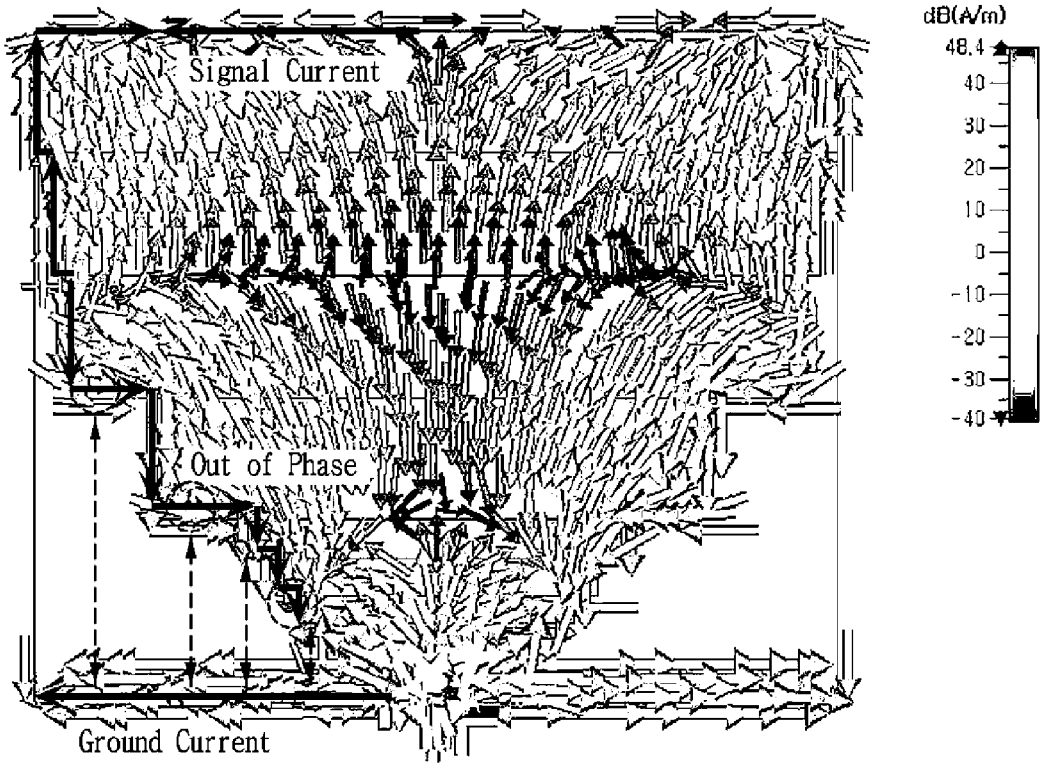
FIG. 18B depicts an electric field distribution in the CPW antenna structure of FIG. 16 having an increased number of steps.

FIG. 18A depicts an electric field distribution in the CPW antenna structure of FIG. 16 having a reduced number of steps. Meanwhile, FIG. 18B depicts an electric field distribution in the CPW antenna structure of FIG. 16 having an increased number of steps. In relation to this, the electric field distribution in the CPW antenna structure is shown at 2.1 GHz, but is not limited thereto.

Referring to FIGS. 16 and 18A and FIGS. 13 and 18B, a surface current may be generated as the antenna resonates when it is half-wavelength long at a frequency. Accordingly, when a surface current in the radiator region 1110*c* and 1110*d* is opposite in phase to a surface current in the first and second ground regions 1150*b* and 1160, the antenna may radiate a radio signal. Consequently, the radiation of radio signals may be done through a lateral region and an upper region of the radiator region 1110*c* and 1110*d*.

Meanwhile, if the number of multiple resonance points is increased by increasing the number of steps in the radiator region 1110*d*, as shown in FIGS. 16 and 18A, the number of points at which a current opposite in phase to the surface current in the first and second ground regions 1150*b* and 1160 increases. By this, an antenna operation band is added to increase the antenna radiation efficiency, thereby enabling the antenna structure to operate as an antenna over a wide band.

Figure 19:
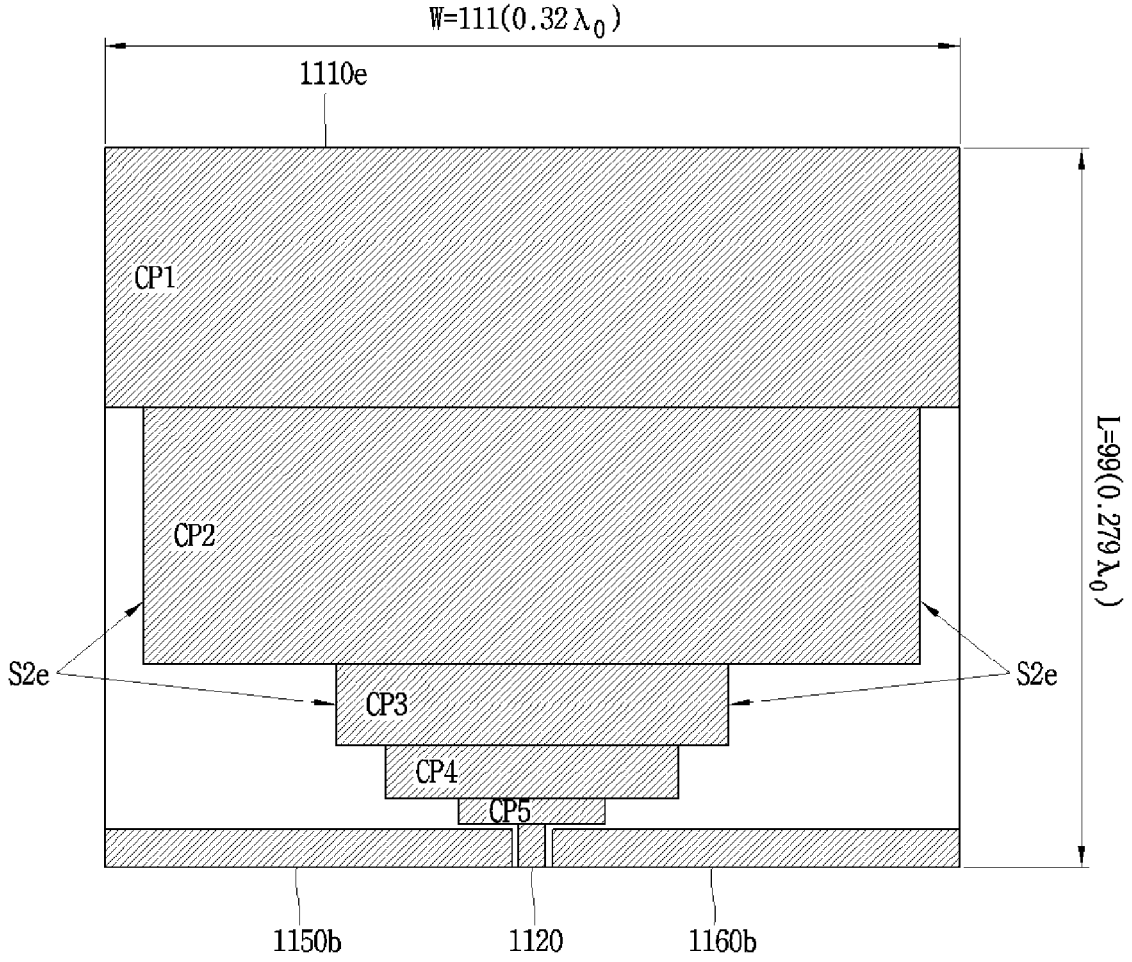
FIG. 19 depicts a broadband CPW antenna assembly with a feeding portion and a radiator region that have a symmetric structure according to another embodiment.

Meanwhile, Meanwhile, a broadband CPW antenna assembly according to the present disclosure may have various structures depending on applications. In relation to this, both the feeding portion and radiator region of the broadband CPW antenna assembly may have a symmetric structure, which may increase the length and width of each of the conductive patterns of the radiator region. FIG. 19 depicts a broadband CPW antenna assembly with a feeding portion and a radiator region that have a symmetric structure according to another embodiment. In relation to this, in a transparent antenna implemented on transparent glass such as glass for a vehicle, both the feeding portion and the radiator region may be formed in a symmetric structure depending on antenna size limitations, and the length and width of each of the conductive patterns of the radiator region may be increased or decreased.

Referring to FIG. 19, the antenna assembly may include a dielectric substrate 1010, a radiator region 1110*e*, a first ground region 1150*b*, and a second ground region 1160*b*. A detailed description of the configuration of FIG. 19 will be replaced with the descriptions of FIG. 13 and FIG. 16, focusing on differences with FIG. 13 and FIG. 16.

The first ground region 1150*b* may be disposed on one side of the feed line 1120 disposed on the dielectric substrate 1010. In the radiator region 1110*e*, a first side S1*e* and a second side S2*e* corresponding to the opposite side of the first side S1*e* may form end portions of conductive patterns such that the conductive patterns having different widths are formed in a plurality of step structures. On the first side S1*e* of the radiator region 1110*e*, the conductive patterns having different widths may be formed in a plurality of step structures in the entire regions. Likewise, on the second side S2*e* of the radiator region 1110*e*, the conductive patterns having different widths may be formed in a plurality of step structures in the entire regions. The radiator region 1110*e* may be configured to include a plurality of conductive patterns CP1, CP2, . . . , CP5. The number of the plurality of conductive patterns is not limited to the configuration illustrated in FIG. 19, but may vary depending on applications. Although the number of the plurality of conductive patterns CP1, CP2, . . . , CP5 in FIG. 19 is equal to the number of the plurality of conductive patterns in FIG. 16, each conductive pattern may differ in length and width.

In FIG. 16, the overall antenna size is implemented as 148×123 mm, which corresponds to a wavelength of 0.34×0.29. In FIG. 19, the overall antenna size is implemented as 111×93 mm, which corresponds to a wavelength of 0.32×0.27.

Referring to FIGS. 13, 16, and 19, the radiator region 1110*c*, 1110*d*, and 1110*e* of the broadband CPW antenna assembly may be formed in a symmetric structure with respect to the feed line 1120. Specifically, the conductive patterns of the radiator region 1110*c*, 1110*d*, and 1110*e* may be disposed symmetrically in the other axial direction with respect to an extension line of the feed line 1120 formed in the one axial direction.

Figure 20A:
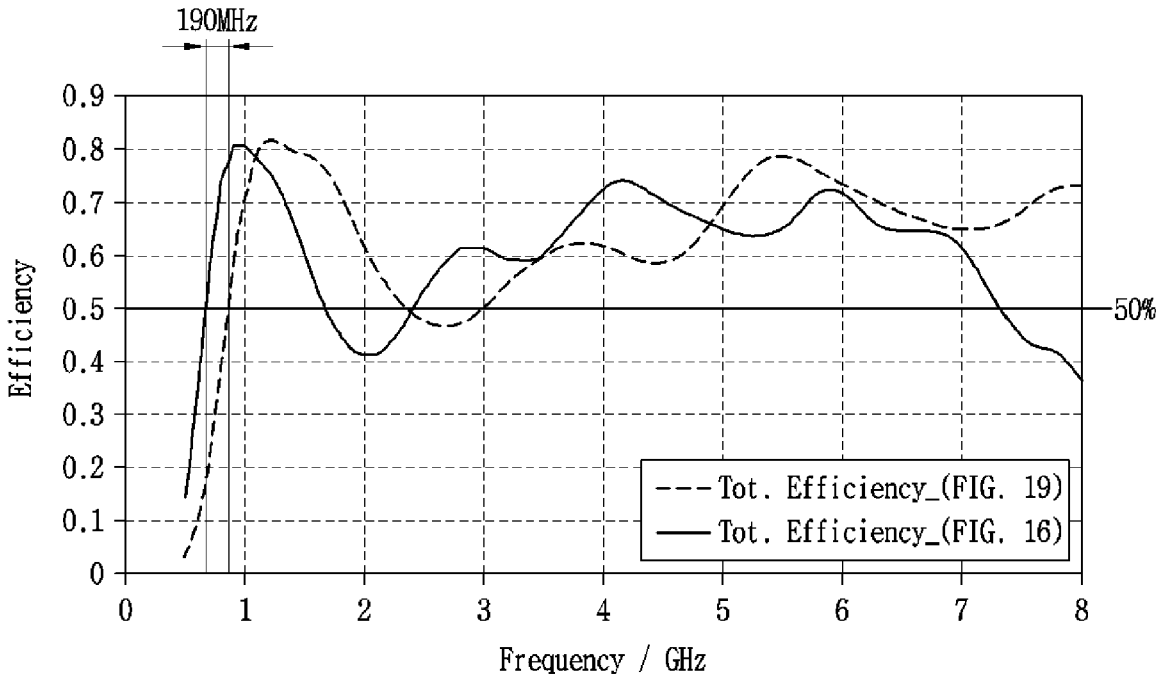
FIG. 20A shows a comparison of efficiency characteristics of the broadband CPW antenna assemblies of FIGS. 16 and 19.
Figure 20B:
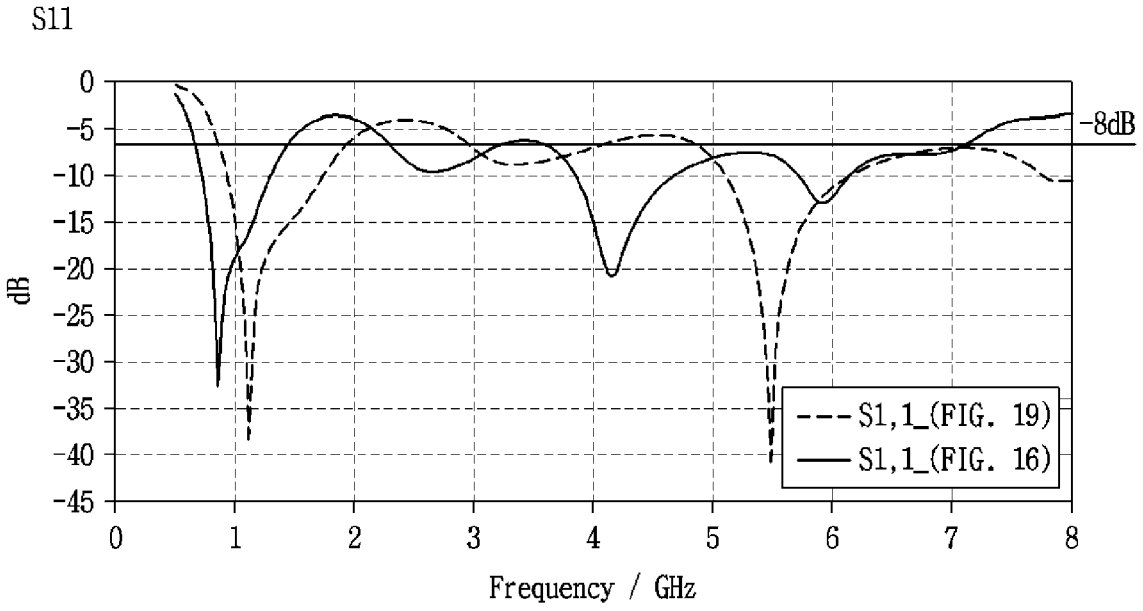
FIG. 20B shows a comparison of reflection loss characteristics of the broadband CPW antenna assemblies of FIGS. 16 and 19.

The antenna performance of the broadband CPW antenna assemblies of FIGS. 16 and 19 will be described below. FIG. 20A shows a comparison of efficiency characteristics of the broadband CPW antenna assemblies of FIGS. 16 and 19. Meanwhile, FIG. 20B shows a comparison of reflection loss characteristics of the broadband CPW antenna assemblies of FIGS. 16 and 19.

Referring to FIG. 20A, the antenna structure of FIG. 16 is configured in such a way as to have an efficiency of 50% or higher at about 700 MHz by increasing the size of the radiator region with respect to a 50% efficiency bandwidth, except for the feeding portion, as compared to FIG. 19. While the antenna structure of FIG. 19 operates from 860 MHz, the antenna structure of F IG. 16 operates from 670 MHz.

Accordingly, the antenna structure of FIG. 16, in which the length and width of the conductive patterns are increased, is configured to operate at a frequency as low as about 190 MHz, compared to the antenna structure of FIG. 19. Meanwhile, the antenna structure of FIG. 16 may have an about 76% increase in antenna area compared to the antenna structure of FIG. 19. Referring to FIG. 20B, the antenna structures of FIGS. 16 and 19 have reflection loss characteristics of −8 dB or lower across the entire range.

Broadband CPW antenna assemblies according to various embodiments of the present disclosure are configured to have a short feed line length, and its conductive patterns are formed in a plurality of step structures so that the antenna operates over a wide band. Meanwhile, in some embodiments, the first and second ground regions are configured in an asymmetric structure, thereby improving the antenna radiation efficiency and reduce the overall antenna size.

In relation to this, configurations and technical features of broadband CPW antenna assemblies according to various embodiments will be described with reference to FIGS. 5 to 20B. Referring to FIGS. 5 to 20B, the width of the conductive patterns may increase in the upper region of the radiator region 1110 and 1110*a* to 1110*e*. In relation to this, the feed line 1120 is disposed in a lower region of the dielectric substrate 1010. Meanwhile, the conductive patterns of the radiator region 1110 and 1110*a* to 1110*e* may be configured in such a way as to become wider in the other axial direction, i.e., the x-axis direction toward a higher position in the one axial direction, i.e., the y-axis direction.

In some embodiments, a current is formed in the radiator region 1110 and 1110*a* to 1110*e* in such a way as to be opposite in phase to a current formed in the first and second ground regions 1150, 1160, 1150*b*, and 1160*b*. Accordingly, the antenna efficiency of the CPW antenna assembly may be improved.

Meanwhile, the length of the radiator region 1110 and 1110*a* to 1110*e* may be reduced so that the length of the conductive patterns in a lower region adjacent to the feed line 1120 is reduced. In relation to this, the conductive patterns of the radiator region 1110 and 1110*a* to 1110*e* may be configured in such way as to become shorter in the one axial direction toward the feed line 1120 in the one axial direction.

Referring to FIGS. 5, 6, 9, 13, 16, and 19, the conductive patterns of the radiator region 1110 and 1110*a* to 1110*e* may be configured in such a way as to become wider in the x-axis direction toward a higher position. Also, the conductive patterns of the radiator region 1110 and 1110*a* to 1110*e* may be configured in such a way as to become longer in the y-axis direction toward a higher position.

Referring to FIGS. 13, 16, and 19, the width of the first conductive pattern CP1 is greater than the width of the second conductive pattern CP2. The width of the second conductive pattern CP2 is greater than the width of the third conductive pattern CP3. Similarly, the width of the fourth conductive pattern CP4 is greater than the width of the fifth conductive pattern CP5. Meanwhile, referring to FIG. 13, the width of the ninth conductive pattern CP9 is greater than the width of the tenth conductive pattern CP10. In a similar manner, conductive patterns disposed in an upper region may be made longer than conductive patterns disposed in a lower region, but some of the conductive patterns disposed in the lower region may be made longer in consideration of antenna impedance matching.

Apart from the symmetric structures of FIGS. 13, 16, and 19, the asymmetric structures of FIGS. 5, 6, and 9 also may be configured in such a way that the width of the conductive patterns disposed in the upper region is greater than the width of the conductive patterns disposed in the lower region. Meanwhile, the asymmetric structures of FIGS. 5, 6, and 9 may be configured in such a way that the length of the conductive patterns in the upper region is greater than the length of the conductive patterns disposed in the lower region. In this manner, the antenna structure may be configured to operate over a wide band by a plurality of step structures whose width and/or length increases gradually.

A broadband CPW antenna structure consisting of such conductive patterns formed in a plurality of step structures may be equalized to an individual folded dipole antenna structure. Each folded dipole may be equalized to resonate at different frequencies, and may operate over a wide band like a folded dipole antenna resonating in a number of different sub-bands. Thus, the more the surface current in the first and second ground regions 1150, 1160, 1150*b*, and 1160*b* and the surface current in the radiator region 1110 and 1110*a* to 1110*e* are out of phase, the more multiple resonance achieved, which attains broadband characteristics.

Referring to FIGS. 5 and 6, the radiator region 1110 and 1110*a* may include a first region R1 which is an upper region and a second region R2 which is a lower region. The first region R1 may correspond to the upper region, and may consist of a plurality of conductive patterns whose end portions on the first side S1 and S1*a* are in different positions on the first side S1 and S1*a*. The second region R2 may correspond to the lower region which lies under the first region R1, and may be formed such that end portions on the first side are spaced apart from a boundary of the first ground region 1150. Meanwhile, the width of the conductive patterns in the first region R1 may be greater in a higher position.

Referring to FIGS. 5 and 6, a boundary of the first side S1 and S1*a* of the radiator region 1110 and 1110*a* in the second region R2 which is the lower region may be disposed to face the boundary of the first ground region 1150, spaced apart from it. Accordingly, the radiator region 1110 and 1110*a* in the second region R2 which is the lower region is disposed adjacent to the boundary of the first ground region 1150, thereby making the overall antenna size smaller and improving the antenna performance.

Referring to FIGS. 5, 6, and 9, at least part of the first side S1, S1*a*, and S1*b* formed by the conductive patterns of the radiator region 1110, 1110*a*, and 1110*b* is formed in a linear structure. Accordingly, the overall antenna size may be made smaller, and the antenna performance may be improved. Moreover, the second side S2 of the radiator region 1110, 1110*a*, and 1110*b* may form a plurality of step structures by the conductive patterns having different widths. Thus, broadband antenna performance may be achieved by a multiple resonance structure.

Referring to FIGS. 5, 6, 9, 13, 16, and 19, the broadband CPW antenna assembly may be implemented as a transparent antenna. As illustrated in FIG. 5, conductive patterns where a current is formed may be implemented as a metal mesh pattern 1020*a*. Meanwhile, a dielectric region where no current is formed may be implemented as a dummy pattern 1020*b*.

Referring to FIGS. 5, 6, 9, 13, 16, and 19, the radiator region 1110 and 1110*a* to 1110*e*, the feed line 1120, the first ground region 1150 and 1150*b*, and the second ground region 1160 and 1160*b* may be formed as a metal mesh pattern in which a plurality of grids is electrically connected. The antenna assembly may be implemented as a transparent antenna on the dielectric substrate 1010. The radiator region 1110 and 1110*a* to 1110*e*, the feed line 1120, the first ground region 1150 and 1150*b*, and the second ground region 1160 and 1160*b*, which constitute the transparent antenna, may be disposed on the dielectric substrate 1010, thereby forming a CPW structure.

Figure 21:
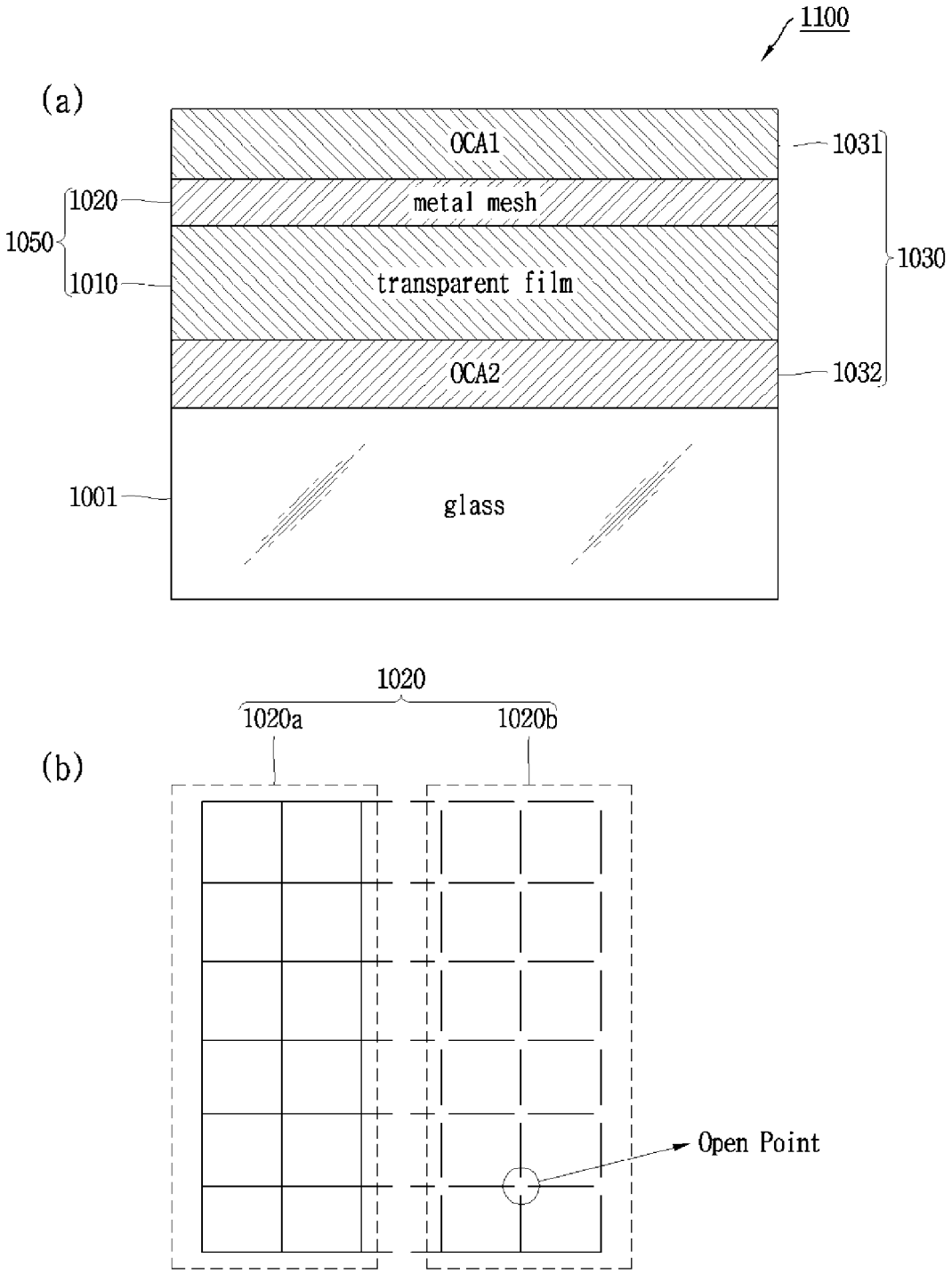
FIG. 21 illustrates a layered structure of an antenna assembly in which a transparent antenna implemented in the form of a metal mesh is disposed on glass and a mesh grid structure.

In some examples, the broadband antenna structure may be implemented as a transparent antenna in the form of a metal mesh on glass or a display. FIG. 21 illustrates a layered structure of an antenna assembly in which a transparent antenna implemented in the form of a metal mesh is disposed on glass and a mesh grid structure.

Referring to (a) of FIG. 21, the layered structure of an antenna assembly on which the transparent antenna is disposed may include glass 1001, a dielectric substrate 1010, a metal mesh layer 1020, and an optical clear adhesive (OCA) layer 1030. The dielectric substrate 1010 may be implemented as a transparent film. The OCA layer 1030 may include a first OCA layer 1031 and a second OCA layer 1032.

The glass 1001 may be made of a glass material, and the second OCA layer 1032 serving as a glass attachment sheet may be attached to the glass 1001. As one example, the glass 1001 may have a thickness of about 3.5 to 5.0 mm, but is not limited thereto. The glass 1001 may constitute the front window 301 of the vehicle illustrated in FIGS. 1A and 1B.

The dielectric substrate 1010 made of the transparent film material may constitute a dielectric region at which conductive patterns of the upper metal mesh layer 1020 are disposed. The dielectric substrate 1010 may have a thickness of about 100 to 150 mm, but is not limited thereto.

The metal mesh layer 1020 may be formed by the plurality of metal mesh grids as illustrated in FIG. 5. Conductive patterns may be configured such that the plurality of metal mesh grids operate as feed lines or radiators. The metal mesh layer 1020 may constitute a transparent antenna region. As one example, the metal mesh layer 1020 may have a thickness of about 2 mm, but is not limited thereto.

The metal mesh layer 1020 may include a metal mesh grid 1020*a* and a dummy mesh grid 1020*b*. In some examples, the first OCA layer 1031 serving as a transparent film layer for protecting the conductive patterns from an external environment may be disposed on upper regions of the metal mesh grid 1020*a* and the dummy mesh grid 1020*b*.

The first OCA layer 1031 may be a protective sheet of the metal mesh layer 1020 and may be disposed on the upper region of the metal mesh layer 1020. As one example, the first OCA layer 1031 may have a thickness of about 20 to 40 mm, but is not limited thereto. The second OCA layer 1032 may be the glass attachment sheet and may be disposed on the upper region of the glass 1001. The second OCA layer 1032 may be disposed between the glass 1001 and the dielectric substrate 1010 made of the transparent film material. As one example, the second OCA layer 1032 may have a thickness of about 20 to 50 mm, but is not limited thereto.

Referring to FIGS. 5, 6, 9, 13, 16, and 19, the CPW antenna assembly may be implemented as a transparent antenna. To this end, the conductive patterns such as the radiator region 1110 and 1110*a* to 1110*e*, the feed line 1120, the first ground region 1150 and 1150*b*, and the second ground region 1160 and 1160*b* may be formed as a metal mesh pattern 1020 in which a plurality of grids is electrically connected. Accordingly, the antenna assembly including the radiator region 1110 and 1110*a* to 1110*e*, the feed line 1120, the first ground region 1150 and 1150*b*, and the second ground region 1160 and 1160*b* may be implemented as the metal mesh grid 1020*a* in which a plurality of grids is connected to one another. On the other hand, the dummy mesh grid 1020*b* disposed at the dielectric region may be implemented as an open dummy pattern in which a plurality of grids is disconnected at connection points (open points).

Accordingly, the transparent antenna region may be divided into an antenna pattern region and an open dummy region. The antenna pattern region may be defined by the metal mesh grid 1020*a* in which the plurality of grids are connected to one another. On the other hand, the open dummy region may be defined by the dummy mesh grid 1020*b* having an open dummy structure disconnected at the connection points.

The foregoing description has been given of the wideband antenna assembly implemented as the transparent antenna according to one aspect. Hereinafter, an antenna system for a vehicle having an antenna assembly according to another aspect will be described. An antenna assembly attached to the vehicle glass may be implemented as a transparent antenna.

Figure 22A:
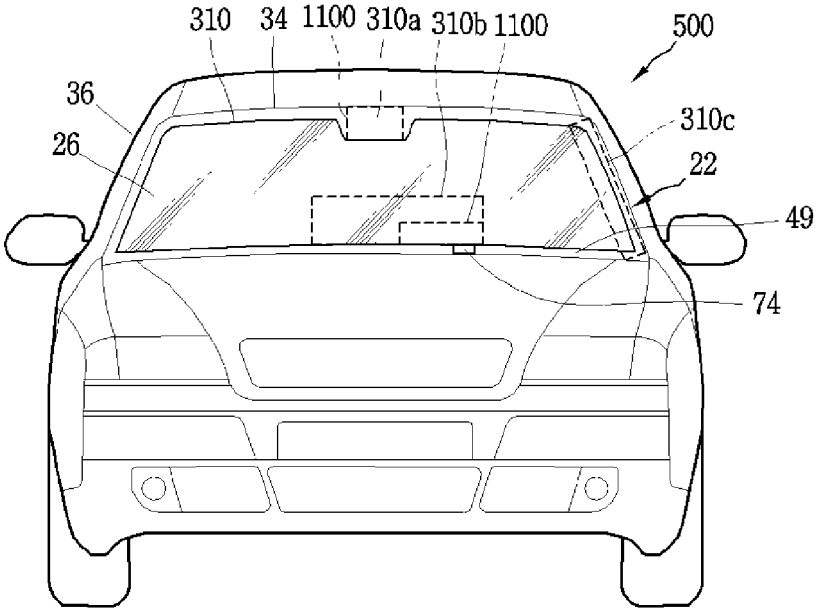
FIG. 22A is a front view of a vehicle in which a transparent antenna can be implemented on glass and FIG. 22B is a view illustrating a detailed configuration of a transparent glass assembly, in which a transparent antenna can be implemented.
Figure 22B:
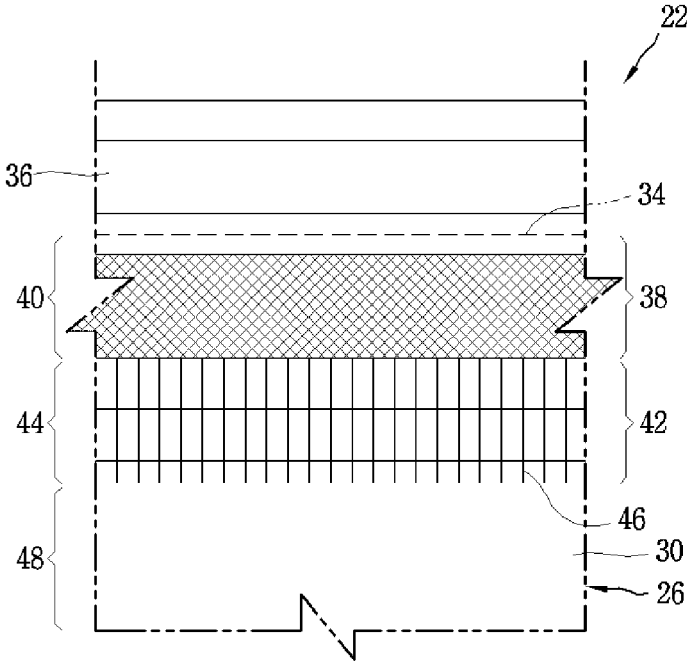

FIG. 22A is a front view of a vehicle in which a transparent antenna can be implemented on glass. FIG. 22B is a view illustrating a detailed configuration of a transparent glass assembly, in which a transparent antenna can be implemented.

Referring to FIG. 22A which is the front view of the vehicle 500, a configuration in which the transparent antenna for the vehicle can be disposed is illustrated. A pane assembly 22 may include an antenna disposed on an upper region 310*a*. Additionally, the pane assembly 22 may include a translucent pane glass 26 formed of a dielectric substrate. The antenna of the upper region 310*a* may support any one or more of a variety of communication systems.

The antenna disposed on the upper region 310*a* of the front window 310 of the vehicle may operate in a mid band MB, a high band HB, and a 5G Sub 6 band of 4G/5G communication systems. The front window 310 of the vehicle may be formed of the translucent pane glass 26. The translucent pane glass 26 may include a first part 38 at which the antenna and a portion of a feeder are formed, and a second part 42 at which another portion of the feeder and a dummy structure are formed. The translucent pane glass 26 may further include external regions 30 and 36 at which conductive patterns are not formed. For example, the outer region 30 of the translucent pane glass 26 may be a transparent region 48 formed to be transparent to secure light transmission and a field of view.

Although it is exemplarily illustrated that the conductive patterns can be formed at a partial region of the front window 310, another example may illustrate that the conductive patterns extend to the side glass 320 of FIG. 1B, the rear glass 330 of FIG. 3C, and an arbitrary glass structure. An occupant or driver in the vehicle 20 can see roads and surrounding environments through the translucent pane glass 26 generally without obstruction by the antenna disposed at the upper region 310*a*.

Referring to FIGS. 22A and 22B, the antenna disposed at the upper region 310*a* may include a first part 38 corresponding to an entire first region 40 of the translucent pane glass 26, and a second part 42 corresponding to an entire second region 44 of the translucent pane glass 26 located adjacent to the first region 40. The first part 38 may have a greater density (i.e., a larger grid structure) than the second part 42. Because the density of the first part 38 is greater than the density of the second part 42, the first part 38 may be perceived to be more transparent than the second part 42. Also, antenna efficiency of the first part 38 may be higher than antenna efficiency of the second part 42.

Accordingly, it may also be configured such that an antenna radiator is disposed at the first part 38 and a dummy radiator (dummy portion) is disposed at the second part 42. When the antenna assembly 1100 is implemented at the first part 38 that is the upper region 310*a* of the front glass 310 of the vehicle, the dummy radiator or a portion of the feed line may be disposed at (attached to) the second part 42.

In this regard, the antenna region may be implemented at the upper region 310*a* of the front glass 310 of the vehicle. The conductive patterns in the form of the metal mesh grid constituting the antenna may be disposed at the first part 38. In some examples, a dummy mesh grid may be disposed at the first part 38 for visibility. In addition, in view of maintaining transparency between the first part 38 and the second part 42, conductive patterns in the form of the dummy mesh grid may also be disposed at the second part 42. An interval between mesh grids 46 disposed at the second part 42 may be wider than an interval between mesh grids disposed at the first part 38.

Conductive mesh grids disposed at the first part 38 of the antenna disposed at the upper region 310*a* may extend up to a region including a peripheral part 34 and the second part 42 of the translucent pane glass 26. The antenna of the upper region 310*a* may extend in one direction along the peripheral part 34.

The antenna assembly 1100 such as the transparent antenna may be disposed at the upper region 310*a* of the front glass 310 of the vehicle, but is not limited thereto. When the antenna assembly 1100 is disposed at the upper region 310*a* of the front glass 310, the antenna assembly 1100 may extend up to an upper region 38 of the translucent pane glass 26. The upper region 38 of the translucent pane glass 26 may have lower transparency than other portions. A part of the feeder and other interface lines may be disposed at the upper region 38 of the translucent pane glass 26. When the antenna assembly 1100 is disposed at the upper region 310*a* of the front glass 310 of the vehicle, the antenna assembly 1100 may cooperate with the second antenna system 1000*b* of FIGS. 3A to 3C.

The antenna assembly 1100 may be disposed at the lower region 310*b* or the side region 310*c* of the front glass 310 of the vehicle. When the antenna assembly 1100 is disposed at the lower region 310*b* of the front glass 310 of the vehicle, the antenna assembly 1100 may extend up to a lower region 49 of the translucent pane glass 26. The lower region 49 of the translucent pane glass 26 may have lower transparency than other portions. A part of the feeder and other interface lines may be disposed at the lower region 49 of the translucent pane glass 26. A connector assembly 74 may be disposed at the lower region 49 of the translucent pane glass 26.

When the antenna assembly 1100 is disposed at the lower region 310*b* or the side region 310*c* of the front glass 310 of the vehicle, the antenna assembly 1100 may cooperate with the internal antenna system 1000 of the vehicle illustrated in FIGS. 3A to 3C. However, the cooperation configuration between the antenna system 1000 and the second antenna system 1000*b* is not limited thereto and may vary depending on applications. In some examples, the antenna assembly 1100 may alternatively be disposed at the side glass 320 of the vehicle of FIG. 1B.

Figure 23:
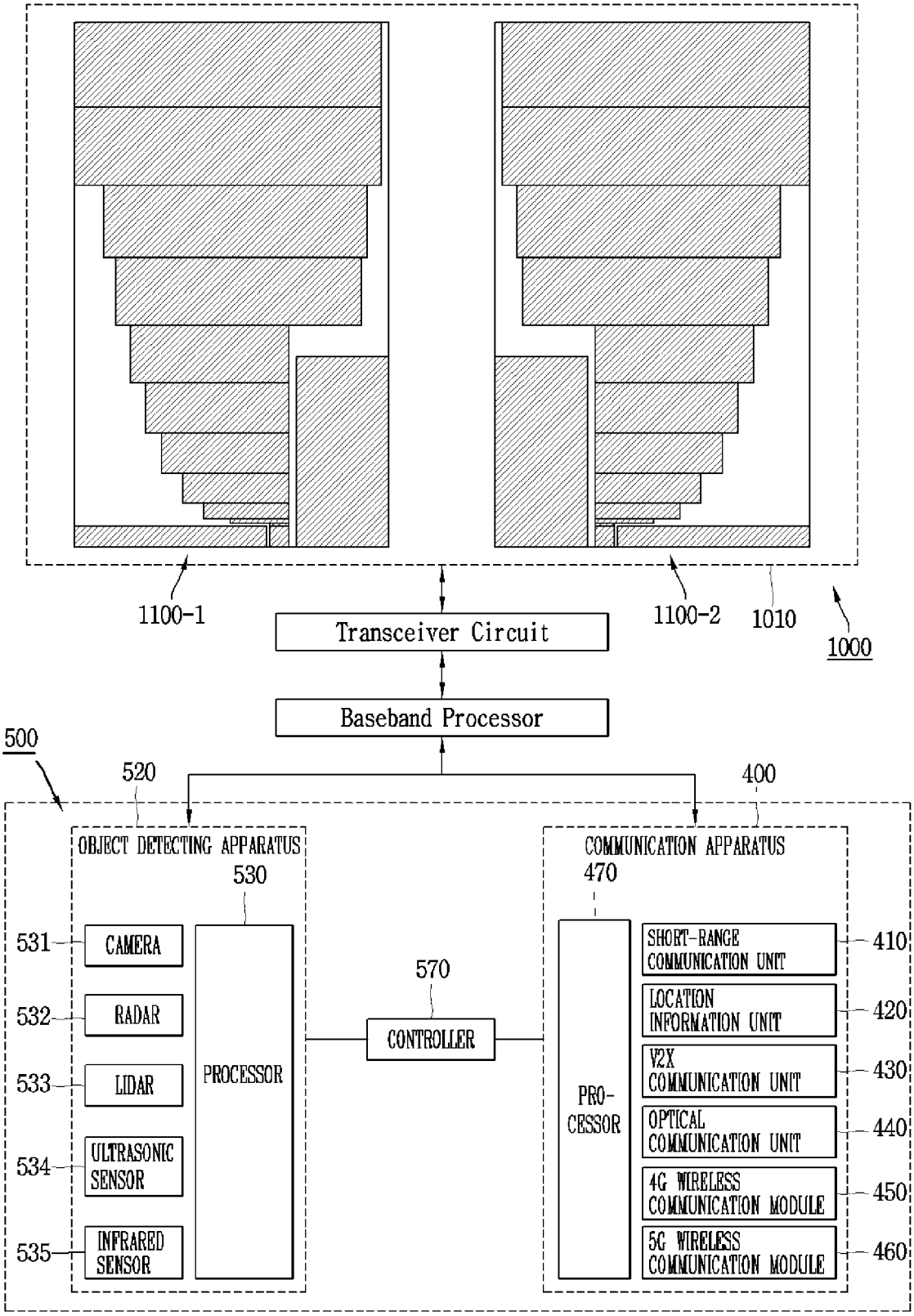
FIG. 23 is a block diagram illustrating a configuration of a vehicle to which a vehicle antenna system is mounted, according to one example.

Referring to FIGS. 1A to 22B, the antenna system 1000 for the vehicle including the antenna assembly 1100 may include a transparent pane assembly 1050 of FIG. 21. FIG. 23 is a block diagram illustrating a configuration of a vehicle on which a vehicle antenna system is mounted, according to an example.

Referring to FIGS. 1A to 22, the vehicle 500 may include the vehicle antenna system 1000. Referring to FIGS. 1A, 1B, and 22A, the vehicle 500 may include a conductive vehicle body operating as an electrical ground.

Referring to FIGS. 1A to 23, the wideband antenna system 1000 may be mounted on a vehicle. The antenna system may perform short-range communication, wireless communication, V2X communication, and the like by itself or through the communication apparatus 400. To this end, the baseband processor 1400 may be configured to receive signals from or transmit signals to adjacent vehicles, RSUs, and base stations through the antenna system 1000.

Alternatively, the baseband processor 1400 may be configured to receive signals from or transmit signals to adjacent vehicles, RSUs, and base stations through the communication apparatus 400. Here, the information related to adjacent objects may be acquired through the object detecting apparatus such as the camera 531, the radar 532, the LiDar 533, and the sensors 534 and 535 of the vehicle 300. Alternatively, the baseband processor 1400 may be configured to receive signals from or transmit signals to adjacent vehicles, RSUs, and base stations through the communication apparatus 400 and the antenna system 1000.

The vehicle antenna system 1000 may include a glass 310 constituting a window of the vehicle. Meanwhile, the vehicle antenna system 1000 may include a dielectric substrate 1010 that is attached to the glass 310 and configured to form mesh grid-like conductive patterns. Moreover, the antenna system 1000 may include antenna assemblies 1100-1 and 1100-2. In relation to this, the number of antenna assemblies 1100-1 and 1100-2 may vary depending on applications, in consideration of multiple input multiple output MIMO. In relation to this, the above-described configurations and technical features of antenna assemblies according to various embodiments of the present disclosure are also applicable to the following description.

The antenna assemblies 1100-1 and 1100-2 each may include a radiator region 1110 and 1110*a* to 1110*e*, a first ground region 1150 and 1150*b*, and a second ground region 1160 and 1160*b*. In the radiator region 1110 and 1110*a* to 1110*e*, a first side S1 and S1*a* to S1*e* and a second side S2 and S2*c* to S2*e* corresponding to the opposite side of the first side may form end portions of conductive patterns such that the conductive patterns having different widths are formed in a plurality of step structures. The first ground region 1150 and 1150*b* may be disposed on one side of a feed line 1120 disposed on the dielectric substrate 1010. The second ground region 1160 and 1160*b* may be disposed on the other side of the feed line 1120 disposed on the dielectric substrate 1010.

The first ground region 1150 and 1150*b* may be formed to have a length greater than or equal to the second ground region 1160 and 1160*b* in one axial direction. For example, in the feeding structures of FIGS. 5 and 6, the first ground region 1150 may be made longer than the second ground region 1160 in one axial direction. In another example, in the feeding structures of FIGS. 9, 13, 16, and 19, the first ground region 1150*b* may be equal in length to the second ground region 1160*b* in one axial direction. Meanwhile, the number of steps on the second side S2 and S2*c* to S2*e* in the radiator region 1110 and 1110*a* to 1110*e* may be greater than or equal to the number of steps on the first side S1 and S1*a* to S1*e*.

Meanwhile, at least part of the first side S1, S1*a*, and S1*b* formed by the conductive patterns of the radiator region 1110, 1110*a*, and 1110*b* may be formed in a liner structure. The second side S2 and S2*c* to S2*e* in the radiator region 1110 and 1110*a* to 1110*e* may form a plurality of step structures by the conductive patterns having different widths.

Meanwhile, the feed line 1120, the radiator region 1110, 1110*a*, and 1110*b*, the first ground region 1150 and 1150*b*, and the second ground region 1160 and 1160*b* may constitute an antenna module 1100-1 and 1100-2. The antenna system 1000 may further include a transceiver circuit 1250 and a processor 1400 that are operably coupled to the antenna module 1100-1 and 1100-2 through the feed line 1120.

The transceiver circuit 1250 may control the antenna module 1100-1 and 1100-2 so that a radio signal in at least one of first to third bands is radiated through the antenna module 1100-1 and 1100-2. The processor 1400 may be operably coupled to the transceiver circuit 1250, and configured to control the transceiver circuit 1250.

In relation to this, the second band may be set higher than the first band, and the third band may be set higher than the second band. For example, the first band corresponding to LB may be set to include 800 MHz, but is not limited thereto. The second band corresponding to MB/HB may be set to include 2,200 MHz, but is not limited thereto. The third band corresponding to UHB or Sub5 band may be set to include 3,500 MHz, but is not limited thereto.

The processor 1400 may perform multiple input multiple output MIMO by controlling to radiate first and second radio signals having different data through the antenna module 1100-1 and 1100-2. Meanwhile, the processor 1400 may control the transceiver circuit 1250 so that radio signals of different bands are applied to the feed line 1120. Thus, the processor 1400 may be configured to perform carrier aggregation CA or dual connectivity DC through a first antenna element 1100-1 and a second antenna element 1100-2 of the antenna module. The first antenna element 1100-1 and the second antenna element 1100-2 may be disposed in a symmetric structure with respect to one axis as illustrated in FIG. 22.

Accordingly, the first ground region in the first antenna element 1100-1 may be disposed on the other side of the feed line, and the second ground region in the second antenna element 1100-2 may be disposed on one side of the feed line. In relation to this, a ground sharing structure may be formed in such a way that the first ground regions are interconnected while the antenna elements are disposed adjacent to each other. However, both the first antenna element 1100-1 and the second antenna element 1100-2 may be sequentially disposed in the first ground region, the radiation region, and the second ground region, without being limited to the symmetric arrangement structure of FIG. 22.

The processor 1400 may control the transceiver circuit 1250 so as to apply a first radio signal and a second radio signal of different bands are applied to the first antenna 1100-1 and the second antenna 1100-2. To this end, different RF chains may be respectively connected to different ports of the antenna elements 1100-1 and 1100-2. Thus, a first RF chain of the transceiver circuit 1250 may apply a first signal of a first band to a first feed line. On the other hand, a second RF chain of the transceiver circuit 1250 may apply a second signal of a second band to a second feed line. Accordingly, carrier aggregation CA and/or dual connectivity DC may be performed by combining (signals of) different bands by using a single antenna element.

The foregoing description has been given of a broadband antenna assembly disposed in a vehicle and an antenna system for a vehicle having the same. Hereinafter, technical effects of the wideband antenna assembly disposed in the vehicle and the antenna system for the vehicle having the same will be described.

In some implementations, an antenna made of a transparent material that operates in a wideband range and can provide LTE and 5G communication services can be provided by forming a first slot inside a first patch and a second slot in a second patch.

In some implementations, a transparent antenna made of a transparent material, which has a radiator region including conductive patterns with different widths so as to form multiple resonance points and can operate in a wideband range, can be provided.

In some implementations, an entire size of a transparent antenna and a feeding loss can be minimized by minimizing a length of feed lines.

In some implementations, an antenna structure made of a transparent material that can be minimized in antenna size while operating in a wideband range by employing a CPW feeding structure and a radiator structure, in which ground regions are formed in an asymmetric structure, can be provided.

In some implementations, an antenna structure of a transparent material, which can obtain improved antenna efficiency and transparency while operating in a wideband range by implementing conductive patterns in a metal mesh structure and defining a dummy pattern even at a dielectric region, can be provided.

In some implementations, a structure, in which an antenna structure made of a transparent material with improved antenna efficiency while operating in a wideband range can be disposed at various positions, such as an upper, lower, or side region of a front window of a vehicle, can be provided.

In some implementations, communication performance can be improved by arranging a plurality of transparent antennas on glass of a vehicle or a display of an electronic device.

Further scope of applicability of the present disclosure will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

In relation to the aforementioned disclosure, design and operations of a transparent antenna operating in a wideband range and a vehicle controlling the same can be implemented as computer-readable codes in a program-recorded medium. The computer-readable medium may include all types of recording devices each storing data readable by a computer system. Examples of such computer-readable media may include hard disk drive (HDD), solid state disk (SSD), silicon disk drive (SDD), ROM, RAM, CD-ROM, magnetic tape, floppy disk, optical data storage element and the like. Also, the computer-readable medium may also be implemented as a format of carrier wave (e.g., transmission via an Internet). The computer may include the controller of the terminal. Therefore, the detailed description should not be limitedly construed in all of the aspects, and should be understood to be illustrative. Therefore, all changes and modifications that fall within the metes and bounds of the claims, or equivalents of such metes and bounds are therefore intended to be embraced by the appended claims.

The invention claimed is:

1. An antenna assembly comprising:

a dielectric substrate; and mesh grid-like conductive patterns disposed on the dielectric substrate, wherein the mesh grid-like conductive patterns comprise:

a radiator region in which a first side and a second side corresponding to an opposite side of the first side form end portions of conductive patterns such that the conductive patterns having different widths are formed in a plurality of step structures;

a feed line electrically connected with the radiator region;

a first ground region disposed on a first side of the feed line; and a second ground region disposed on a second side of the feed line, wherein the first ground region is formed to have a length greater than or equal to that of the second ground region in one axial direction, and wherein a first number of steps on the second side is greater than or equal to a second number of steps on the first side.

2. The antenna assembly of claim 1, wherein the radiator region is disposed only in an upper region of either the first ground region or the second ground region.

3. The antenna assembly of claim 2, wherein the first side in the radiator region is formed in a linear structure, and the second side in the radiator region forms a plurality of step structures by the conductive patterns having different widths.

4. The antenna assembly of claim 1, wherein the first side in the radiator region adjacent to the first ground region in one axial direction is formed in a linear structure.

5. The antenna assembly of claim 1, wherein the first side of the radiator region is formed in M step structures in an upper part of the first ground region, the second side of the radiator region disposed over the second ground region is formed in N step structures, where N is a number greater than M, and the first ground region is made longer than the second ground region in one axial direction.

6. The antenna assembly of claim 1, wherein the first ground region is smaller in width than the second ground region in the other axial direction, which reduces the width of the antenna assembly.

7. The antenna assembly of claim 1, wherein end portions on the first side of the radiator region formed over the first ground region are formed between opposite ends of the first ground region, so that the antenna assembly operates over a wide band by an interaction between a current in the radiator region and a current in the second ground region.

8. The antenna assembly of claim 1, wherein end portions on the second side of the radiator region formed over the second ground region are formed between opposite ends of the second ground region, so that the antenna assembly operates over a wide band by an interaction between a current in the radiator region and a current in the second ground region.

9. The antenna assembly of claim 1, wherein the feed line is disposed in a lower region of the dielectric substrate, and the conductive patterns of the radiator region are configured in such a way as to become wider in the other axial direction toward a higher position in the one axial direction.

10. The antenna assembly of claim 1, wherein the conductive patterns of the radiator region are configured in such a way as to become shorter in the one axial direction toward the feed line in the one axial direction.

11. The antenna assembly of claim 1, wherein the conductive patterns of the radiator region are disposed symmetrically in the other axial direction with respect to an extension line of the feed line formed in the one axial direction.

12. The antenna assembly of claim 1, wherein the conductive patterns of the radiator region are disposed asymmetrically in the other axial direction with respect to an extension line of the feed line formed in the one axial direction, which reduces the width of the antenna assembly.

13. The antenna assembly of claim 1, wherein the radiator region includes:

a first region corresponding to an upper region, and consisting of a plurality of conductive patterns whose end portions on the first side are in different positions on the first side; and a second region corresponding to a lower region which lies under the first region, and formed such that end portions on the first side are spaced apart from a boundary of the first ground region, wherein the width of the conductive patterns in the first region is greater in a higher position.

14. The antenna assembly of claim 13, wherein a boundary of the first side of the radiator region in the second region is disposed to face the boundary of the first ground region, spaced apart therefrom.

15. The antenna assembly of claim 13, wherein at least part of the first side formed by the conductive patterns of the radiator region is formed in a liner structure, and the second side in the radiator region forms a plurality of step structures by the conductive patterns having different widths.

16. The antenna assembly of claim 15, wherein the antenna assembly is implemented as a transparent antenna on the dielectric substrate, and the radiator region, the feed line, the first ground region, and the second ground region, which constitute the transparent antenna, are disposed on the dielectric substrate, thereby forming a co-planar waveguide (CPW) structure.

17. An antenna system for a vehicle, the vehicle including a conductive vehicle body operating as an electrical ground, the antenna system comprising:

a glass constituting a window of the vehicle;

a dielectric substrate that is attached to the glass; and mesh grid-like conductive patterns disposed on the dielectric substrate, wherein the mesh grid-like conductive patterns comprise:

a radiator region in which a first side and a second side corresponding to an opposite side of the first side form end portions of conductive patterns such that the conductive patterns having different widths are formed in a plurality of step structures;

a feed line electrically connected with the radiator region;

a first ground region disposed on a first side of the feed line; and a second ground region disposed on a second side of the feed line, wherein the first ground region is formed to have a length greater than or equal to that of the second ground region in one axial direction, and wherein a first number of steps on the second side is greater than or equal to a second number of steps on the first side.

18. The antenna system for a vehicle of claim 17, wherein at least part of the first side formed by the conductive patterns of the radiator region is formed in a liner structure, and the second side in the radiator region forms a plurality of step structures by the conductive patterns having different widths.

19. The antenna system for a vehicle of claim 17, wherein the radiator region, the first ground region, and the second ground region constitute an antenna module, and the antenna system further comprises:

a transceiver circuit operably coupled to the antenna module through the feed line, that controls the antenna module so that a radio signal in at least one of first to third bands is radiated through the antenna module; and a processor operably coupled to the transceiver circuit, and configured to control the transceiver circuit.

20. The antenna system for a vehicle of claim 19, wherein the processor is configured to perform carrier aggregation CA or dual connectivity DC through a first antenna element and a second antenna element of the antenna module, by controlling the transceiver circuit so that radio signals of different bands are applied to the feed line.

* * * * *